US006776096B2

(12) United States Patent
Naniwa et al.

(10) Patent No.: US 6,776,096 B2
(45) Date of Patent: Aug. 17, 2004

(54) METHOD FOR ATTACHING A FLEXIBLE PRINTING PLATE TO A PLATE CYLINDER

(75) Inventors: Mutsumi Naniwa, Shizuoka (JP); Seishi Kasai, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/288,525

(22) Filed: Nov. 6, 2002

(65) Prior Publication Data

US 2003/0127003 A1 Jul. 10, 2003

(30) Foreign Application Priority Data

Nov. 7, 2001 (JP) ..... P. 2001-341923

(51) Int. Cl.[7] ..... B41F 27/12
(52) U.S. Cl. ..... 101/477; 101/415.1
(58) Field of Search ..... 101/477, 415.1, 101/401.1, 378, 382.1, 383, 384

(56) References Cited

U.S. PATENT DOCUMENTS 6,467,411 B1 * 10/2002 Naniwa et al. ..... 101/477
6,474,236 B1 * 11/2002 Naniwa et al. ..... 101/477
2001/0023648 A1 * 9/2001 Naniwa et al. ..... 101/477
2002/0017208 A1 2/2002 Kasai et al.

FOREIGN PATENT DOCUMENTS

| | | | |
|---|---|---|---|
| EP | 0 246 012 | A2 | 11/1987 |
| EP | 0 950 925 | A2 | 10/1999 |
| EP | 1 099 568 | A1 | 5/2001 |
| EP | 1 127 687 | A2 | 8/2001 |
| JP | 10-193828 | A | 7/1998 |
| JP | 11-20130 | A | 1/1999 |
| JP | 11-59012 | A | 3/1999 |
| JP | 11-105446 | A | 4/1999 |

OTHER PUBLICATIONS

European Search Report dated Mar. 18, 2003.

* cited by examiner

*Primary Examiner*—Leslie J. Evanisko
(74) *Attorney, Agent, or Firm*—Sughrue Mion, PLLC

(57) ABSTRACT

A method of attaching a flexible printing plate having a concavo-convex structure on the rear surface thereof and three or more notches at the plate front edge thereof on a plate cylinder using an apparatus comprising a plate front end positioning mechanism, a printing plate pressing mechanism and a plate rear end fixing mechanism together with a packing sheet having a concavo-convex structure.

12 Claims, 13 Drawing Sheets

METHOD FOR ATTACHING A FLEXIBLE PRINTING PLATE TO A PLATE CYLINDER

FIELD OF THE INVENTION

The present invention relates to a method and apparatus for attaching a printing plate onto a plate cylinder of a printing press. Specifically, the invention relates to a method and apparatus for attaching a flexible printing plate prepared by digital plate making.

BACKGROUND OF THE INVENTION

In a printing press for lithographic printing, it is a common practice to wind and fix a printing plate around a plate cylinder and carry out printing with the plate kept in such a condition.

However, a lithographic printing plate, which is inexpensive and easy to handle and at least the rear surface of which is made of a material other than metal (hereinafter referred to as a flexible printing plate), has a drawback in dimensional stability. For example, the flexible printing plate has a problem in that distortion may occur by handling of the printing plate at the plate attachment or by a frictional force generated between the printing plate and a blanket cylinder during printing and as a result, the print dimension and the accuracy in the printed position relative to printing paper are degraded.

Accordingly, the use of such a flexible printing plate has been limited to a simple printing for a relatively small number of prints wherein a high registration accuracy in the resulting print is not so severely required, and such flexible printing plates have not been used for multi-color high-quality printing and printing using a large printing press.

The above-mentioned distortion of a flexible printing plate caused by the handling at the plate attachment is described in detail below. In FIG. 16, a typical plate-attaching unit 60 is shown. FIG. 16 shows a view of the plate-attaching unit when it is viewed from the direction of the arrow X in FIG. 15. FIG. 15 is a cross-sectional view taken along the line Y—Y shown in FIG. 16.

As is shown in FIG. 15, a plate cylinder 61 of the printing press has such a shape as being obtained by cutting off a part of a cylinder along the axial direction thereof and providing a groove 65 in a substantially flat plane (hereinafter referred to as a flat portion 61*a*), which is the cut edge of cylinder. In the groove 65 are provided a plate front end clamping mechanism 62 that clamps and holds the front end or leading edge of a printing plate 70 and a plate rear end clamping mechanism 63 that clamps and holds the rear end or trailing edge of the printing plate 70. Each of the clamping mechanisms 62 and 63 is provided with a lower tooth 62*b* or 63*b* the upper surface of which constitutes substantially the same level as the flat portion 61*a*, and an upper tooth 62*a* or 63*a* which is rotatably supported by the bottom tooth and capable of clamping and holding the front end of printing plate between the upper surface of the bottom tooth and itself. Further, a position-adjusting mechanism (not shown), which can control the positions of the plate front end clamping mechanism 62 and the plate rear end clamping mechanism 63 in the forward-backward, left-right or oblique direction is provided on the bottom plane of the groove 65.

There is formed a ridge portion 61*c* between the flat portion 61*a* and a curved portion 61*b* of the plate cylinder 61. Though not shown, there is known a plate cylinder in which, for example, the upper surface of the lower tooth in the clamping mechanism, instead of the flat portion, forms a ridge portion together with the curved portion therebetween.

Usually, the portion where the flat portion 61*a* and the curved portion 61*b* are bounded is rounded to form a curved surface with a radius of 5 to 30 mm. Such a rounded portion is also referred to as the ridge portion in the specification.

As shown in FIG. 16, on the upper surface of the lower tooth 62*b* of the plate front end clamping mechanism, protruding registration pins 64 are provided at two positions with a spacing in the axial direction of the plate cylinder 61. At the positions of the upper tooth 62*a* of the plate front end clamping mechanism corresponding to those of the registration pins 64, notches 66 are formed respectively. Further, in a plate front end 70*a* of the printing plate 70 shown by a two-dot chained line in the figure, notches 71 at the positions corresponding to those of registration pins 64.

In the case where a flexible printing plate 70 is attached onto the plate cylinder 61 using, for example, the plate-attaching unit 60 described above, an operator pushes the plate front end 70*a* of the printing plate into a gap between the upper tooth 62*a* and the lower tooth 62*b* of the plate front end clamping mechanism so that the plate front end comes into contact with the two registration pins 64 while the operator holds the plate rear end 70*b* in his hand. At that time, it accidentally happens that the plate front end 70*a* is deformed and fixed in such a deformed state. Specifically, since distance between the two registration pins 64 aligned on plate cylinder 61 is considerably large in the plate cylinder capable of attaching a printing plate of a half-kiku size (approximately 670 mm in width and 560 mm in length) or larger, when the operator pushes a flexible printing plate 70 even slightly in excess at the plate attachment, deformation of the printing plate 70 occurs in such a manner that the plate front end 70*a* protrudes from the spacing between the two registration pins 64 in the pushed direction. However, when the printing plate 70 is pushed insufficiently with care of preventing such deformation, accurate positioning of the printing plate is impossible.

Moreover, as shown in FIG. 15, in the vicinity of the ridge portion 61*c* formed between the flat portion 61*a* and the curved portion 61*b* of the plate cylinder 61, the flexible printing plate 70 is difficult to adjust itself to the outer periphery of plate cylinder 61, and tends to float from the outer periphery of the plate cylinder.

To prevent such floating of the printing plate 70, the operator wraps and attaches the printing plate 70 by rotating the plate cylinder while strongly pulling the plate rear end of the printing plate whose front end has been clamped and held by the plate front end clamping mechanism 62. However, during such operation, the pulled portion in the plate rear end of the flexible printing plate 70 is elongated.

After winding and attaching the printing plate by pulling the plate rear end thereof as described above, the plate rear end of the printing plate is pushed into a gap between the upper and lower teeth of the plate rear end clamping mechanism and fixed by rotating the upper tooth. Then, by moving the plate rear end clamping mechanism in such a direction as to impart tension to the printing plate using a tension-applying mechanism (not shown), the printing plate is brought into close contact with the periphery of plate cylinder, whereby the plate attachment is completed.

In a conventional plate-attaching device, such a tension-applying mechanism for bringing a printing plate into close contact with the peripheral surface of plate cylinder is designed in conformity with a printing plate having a metal substrate such as aluminum. Accordingly, in the case of a flexible printing plate, the plate is elongated to an extent more than necessary.

On the other hand, when the tension-imparting mechanism is designed so as to apply a low tension adapted for flexible printing plates, the tension is not enough and the printing plate fails to get in close contact with the plate cylinder. Even when the printing plate is favorably attached without floating from the plate cylinder, under such a weak tension the printing plate is moved by the frictional force between the blanket cylinder and itself during printing.

As means for resolving the above-described problem of moving printing plate (hereinafter referred to as "plate slippage"), there have been proposed a method of immobilizing the plate on the plate cylinder using a spray paste (Japanese Patent Laid-Open No. 11258/1981), and a method of immobilizing a plate using an adhesive material (e.g., Japanese Patent Publication No. 425/1995 and Japanese Patent Laid-Open No. 104853/1986). But, these methods are not effective from practical viewpoint, since fine position adjustment needed subsequently becomes quite difficult once the plate is bonded to the plate cylinder.

A plate mounting method is proposed in Japanese Patent Laid-Open No. 20130/1999 wherein the positional and dimensional accuracies under high-speed printing are improved by using a sheet material having an initial modulus of elasticity not higher than 300 kgf/mm$^2$ and wherein free slide of the printing plate due to the reduction of the frictional resistance between the plate cylinder and the printing plate is secured by further providing a concavo-convex (matte) surface through a chemical or physical surface treatment or bonding fine particles on the surface of sheet material, whereby smooth registration adjustment can be practiced. However, it has been found that, though this technique enables position registration as well as a fixed clamping, it cannot prevent plate slippage satisfactorily.

On the other hand, a sheet material having a centerline roughness Ra of 2 $\mu$m or larger on at least one surface thereof (Japanese Patent Laid-Open No. 193828/1998) and a packing sheet having a concavo-convex surface provided with a distribution of specified minute protrusions on the surface of a sheet-formed base material (Japanese Patent Laid-Open No. 59012/1999) are proposed. These packing sheets can prevent plate slippage through biting into the back surface of a lithographic printing plate, and further enable delicate position adjustment due to the effect of the surface concavities and convexities. However, even in such packing sheets, the effect of preventing plate elongation and displacement is still insufficient, and the development of more improved method has been expected.

In these years in the field of lithographic printing, many proposals have been made on the system that directly outputs digital image information on a printing plate, owing to the recent improvement of digital imaging technology and the request of raising process efficiency. Such technique is called CTP (Computer-To-Plate) or DDPP (Digital Direct Printing Plate).

The above-described technique has the advantages of achieving good positional accuracy of image with respect to a printing plate and a good registration accuracy in multi-color printing, compared to a conventional plate-making method (in which contact exposure is performed by superimposing a lith film on a printing plate precursor).

As a matter of course, digital plate-making systems using a flexible plate precursor have also been proposed, and owing to their low prices, there exists needs for multi-color printing using such systems. However, since the flexible printing plate have the above-described problems, they cannot make full use of the advantage of good positional accuracy of image resulting from the digital plate-making system. Thus, in multi-color printing, the flexible printing plate has not achieved the same registration accuracy as that of a printing plate having a metal support.

SUMMARY OF THE INVENTION

An object of the invention is to provide a plate-attaching method capable of readily attaching a flexible printing plate prepared digitally without plate distortion, capable of putting into practice with a slight improvement of an already installed printing press, providing the printing plate with a good attached position accuracy and capable of preventing the plate slippage and staining in the non-image area during printing.

Other objects of the invention will become apparent from the following description.

The above-described objects of the invention are attained by the following items:

1. A method of attaching a flexible printing plate on a plate cylinder comprising:
   - providing a flexible printing plate having a concavo-convex structure on the rear surface thereof and three or more notches at the plate front edge thereof;
   - providing an apparatus of attaching a flexible printing plate comprising:
     - a plate front end positioning mechanism comprising:
       - a plate front end clamping mechanism having upper teeth and lower teeth for fixing the plate front end of said printing plate to said plate cylinder; and at least three registration pins respectively provided in said plate front end clamping mechanism in such a manner in that they are respectively opposed to said notches of said printing plate;
     - a printing plate pressing mechanism for pressing said printing plate toward said plate cylinder;
     - a plate rear end fixing mechanism for fixing the plate rear end of said printing plate to said plate cylinder; and
     - a packing sheet having a concavo-convex structure at least on one surface thereof and being wound and fixed around said plate cylinder in such a manner that the surface having the concavo-convex structure is faced said printing plate;
   - positioning and fixing said plate front end to said plate cylinder by inserting said plate front end of said printing plate between said upper and lower teeth of said plate front end clamping mechanism to contact inner peripheral surface of said notches of said plate front end with said at least three registration pins;
   - winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and
   - pressing and fixing said plate rear end of said printing plate in the radial direction of said plate cylinder using said plate rear end fixing mechanism after the completion of said winding;
   - whereby elongation of said flexible printing plate in its maximum printing length in the rotational direction of said plate cylinder during said printing plate attaching operation is controlled not more than 100 μm.

2. A method of attaching a flexible printing plate on a plate cylinder comprising:

providing a flexible printing plate having a concavo-convex structure on the rear surface thereof and at least three fixing holes at the plate front edge thereof;

providing an apparatus of attaching a flexible printing plate comprising:

a plate front end positioning mechanism comprising:

a plate front end clamping mechanism having upper teeth and lower teeth for fixing the plate front end of said printing plate to said plate cylinder; registration pins provided in said plate front end clamping mechanism; and a pin contact member, which has higher rigidity than said printing plate, is attached to said registration pins and has at least three fixing pins for fixing said printing plate;

a printing plate pressing mechanism for pressing said printing plate toward said plate cylinder;

a plate rear end fixing mechanism for fixing the plate rear end of said printing plate to said plate cylinder; and a packing sheet having a concavo-convex structure at least on one surface thereof and being wound and fixed around said plate cylinder in such a manner that the surface having the concavo-convex structure is faced said printing plate;

positioning and fixing said plate front end to said plate cylinder by inserting said respective fixing pins of said pin contact member between said upper and lower teeth of said plate front end clamping mechanism into said respective fixing holes of said printing plate;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate in the radial direction of said plate cylinder using said plate rear end fixing mechanism after the completion of said winding;

whereby elongation of said flexible printing plate in its maximum printing length in the rotational direction of said plate cylinder during said printing plate attaching operation is controlled not more than 100 μm.

3. A method of attaching a flexible printing plate on a plate cylinder comprising:

providing a flexible printing plate having a concavo-convex structure on the rear surface thereof and at least three fixing holes at the plate front edge thereof;

providing an apparatus of attaching a flexible printing plate comprising:

a plate front end positioning mechanism comprising:

a plate front end clamping mechanism having upper teeth and lower teeth for fixing the plate front end of said printing plate to said plate cylinder; and registration pins provided in said plate front end clamping mechanism;

a printing plate pressing mechanism for pressing said printing plate toward said plate cylinder;

a plate rear end fixing mechanism for fixing the plate rear end of said printing plate to said plate cylinder;

a packing sheet having a concavo-convex structure at least on one surface thereof and being wound and fixed around said plate cylinder in such a manner that the surface having the concavo-convex structure is faced said printing plate; and a pin contact member which has higher rigidity than said printing plate and has at least three fixing pins for fixing said printing plate;

inserting said fixing pins of said pin contact member into said fixing holes of said printing plate, respectively, to fix;

positioning and fixing said printing plate to said plate cylinder by fixing a leading edge of said pin contact member to said registration pins between said upper and lower teeth of said plate front end clamping mechanism;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate in the radial direction of said plate cylinder using said plate rear end fixing mechanism after the completion of said winding;

whereby elongation of said flexible printing plate in its maximum printing length in the rotational direction of said plate cylinder during said printing plate attaching operation is controlled not more than 100 μm.

4. A method of attaching a flexible printing plate set forth in any one of items 1 to 3, wherein the concavo-convex structure of said packing sheet has Ra (Ra: centerline average roughness) of less than 2 μm.

5. A method of attaching a flexible printing plate set forth in any one of items 1 to 4, wherein the concavo-convex structure of said packing sheet has Ra/Rz (Rz: ten-point average roughness) of less than 0.17.

6. A method of attaching a flexible printing plate set forth in any one of items 1 to 3, wherein a concavo-convex structure of the rear surface of said printing plate has Ra value of less than 1.5 μm.

Figure 1:
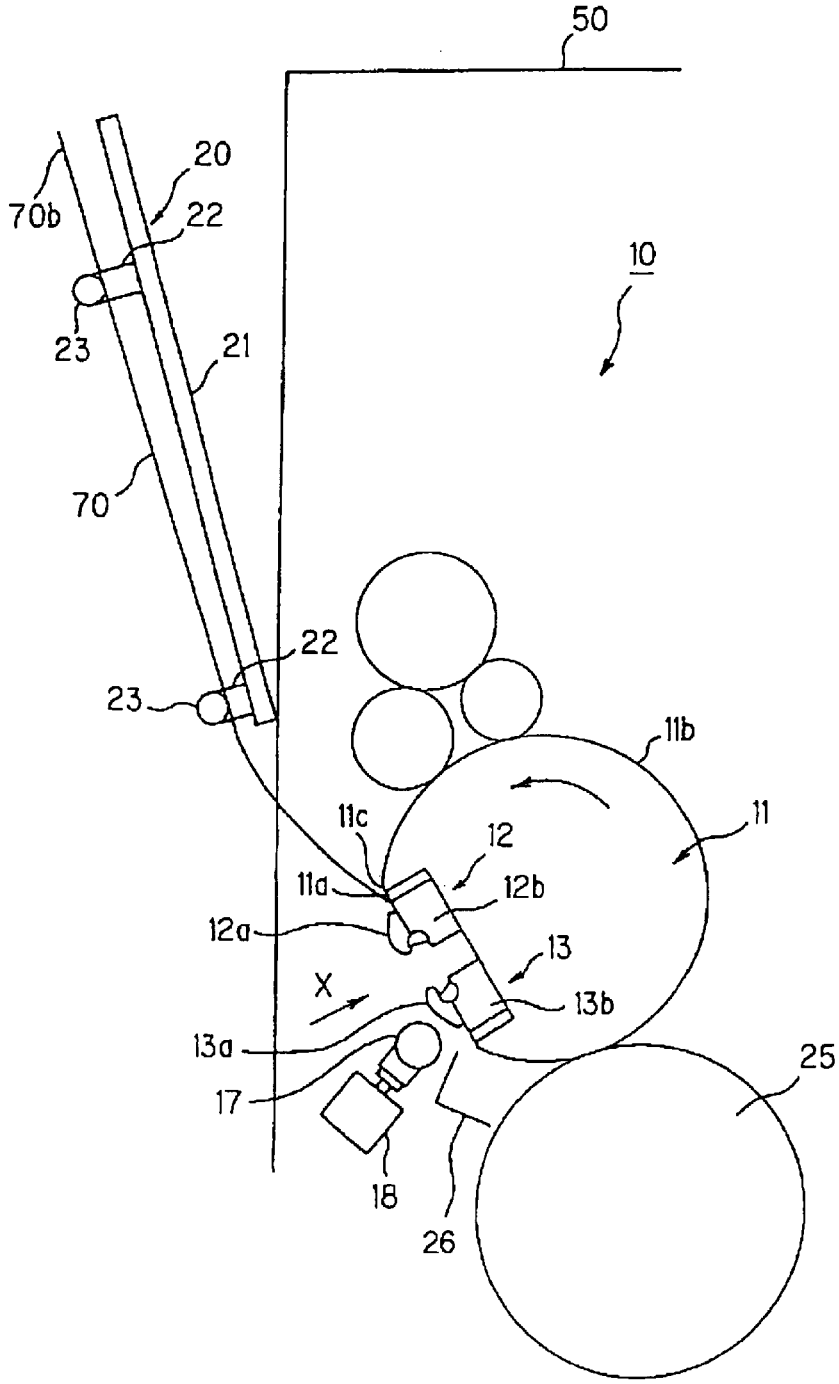
FIG. 1 is a schematic view showing a first embodiment of the invention.

In the figures, the numerals denote the following members, respectively:

10, 90 and 100: Printing plate-attaching unit
11, 91 and 101: Plate cylinder
11*c*, 91*c* and 101*c*: Ridge portion
12, 92 and 102: Plate front end clamping mechanism
13, 93 and 103: Plate rear end clamping mechanism
12*a*, 13*a*, 92*a* and 93*a*: Upper tooth
12*b*, 13*b*, 92*b* and 93*b*: Lower tooth
Registration pin
17: Pressure roller (Pressure member)
20: Guide member
25: Blanket cylinder
27: Packing sheet
30 and 40: pin contact member
70 and 80: Flexible printing plate
117: Brush (Planner pressure member)

DETAILED DESCRIPTION OF THE INVENTION

According to the method of item 1 described above, since the flexible printing plate is positioned by contacting with three or more registration pins, the distance between the registration pins on the plate cylinder is narrow, whereby the deformation of printing plate in such a manner that the plate front end protrudes from the spacing between the registration pins. Also, during the plate attachment by winding the printing plate around the plate cylinder, the pressure member presses the printing plate toward the entire outer peripheral surface including the ridge portion thereof, thereby bringing the printing plate into close contact with the outer peripheral surface of the plate cylinder. Thus, the operator need not wind and attach the printing plate by pulling the plate rear end thereof. Since tension is not applied positively to the printing plate, the elongation of printing plate is little. Even when the elongation of printing plate due to the resistance of the pressure member during the printing plate-attaching operation is taken into account, the elongation of the printing plate in the maximum print length can be controlled less than 100 $\mu$m.

Further, by forming convexities and concavities in both of the packing sheet and the rear surface of the printing plate, plate slippage, which may occur due to the frictional force between the blanket cylinder and the plate itself during printing in the case wherein the tension applied to the printing plate is zero or very small, can be prevented since the concavo-convex surfaces are effectively engaged with each other.

Accordingly, the dimensional stability of the printing plate during plate-attaching operation and printing operation markedly is improved thereby achieving the registration accuracy required for multi-color printing comparable with that achieved by a printing plate having a metal support. Furthermore, the attaching property of the flexible printing plate on the plate cylinder is greatly improved so that the operator's workload can be reduced.

It should be noted that, in a conventional plate-attaching method, it is impossible to control the plate elongation in the maximum print length in the direction of cylinder rotation at the time of attaching a flexible plate to 100 $\mu$m or less, which is the essential feature of the invention. The first reason for this is that, as described above, when the operator winds the printing plate on the plate cylinder by rotating the plate cylinder while strongly pulling the plate rear end of the printing plate in order to prevent the plate from floating, the printing plate is easily stretched by 100 $\mu$m or more. Secondly, since the tension-applying mechanism described above is designed in conformity with a printing plate having a metal support such as aluminum, when it is applied to the flexible printing plate, the printing plate is easily stretched by 100 $\mu$m or more. When the tension-applying mechanism is designed so as to apply such a low tension adapted to the flexible printing plate that the elongation of printing plate does not exceed 100 $\mu$m, the tension is not enough and the printing plate fails to get in close contact with the plate cylinder. Even when the printing plate is favorably attached without floating from the plate cylinder, under such a weak tension the printing plate is moved by the friction force between the blanket cylinder and itself during printing.

The elongation of printing plate in the maximum print length in the rotational direction of the plate cylinder at the time of printing plate-attaching operation of less than 100 $\mu$m can be achieved with any type of flexible printing plate regardless of the material and size (length, width and thickness) thereof, because according to the printing plate-attaching method, the intentional application of tension to the printing plate is averted as described above.

Since the packing sheet provided with the function of preventing plate slippage has a concavo-convex structure on at least one surface thereof and is wound and fixed around the plate cylinder in such a manner that the concavo-convex surface is faced to the printing plate, the packing sheet acts to satisfactorily prevent the plate slippage. When the concavities and convexities are pressed against the rear surface of a printing plate, they dent and bite into the rear surface of printing plate. Accordingly, the occurrence of plate slippage on the plate cylinder caused by, for example, the pressure applied to the printing plate from a printing press during printing can be surely prevented.

According to the methods of items 2 and 3 described above, the plate front end of the printing plate is protected by a highly rigid pin contact member having at least three fixing pins and thus the deformation of the plate front end can be prevented. Hence, the number of registration pin need not be increased, and these methods can be relatively easily applied to existing printing presses or plate making apparatus.

As the material for the pin contact member having higher rigidity than the printing plate, metal or the like can be used, although it is not specifically limited.

According to the method of item 4, the occurrence of stain in the non-image area during printing can be prevented.

According to the method of item 5, the effect of preventing plate slippage during printing is further improved.

The method of item 6 is preferable because the occurrence of stain in the non-image area during printing can be prevented and scratch of the printing plate is also prevented.

According to another embodiment of the invention, the packing sheet comprising a support having an initial modulus of elasticity of 350 kgf/mm$^2$ or more is used in the above-described printing plate-attaching method. With the use of such a support, the convexities and concavities of the packing sheet effectively functions without being flattened by the printing pressure.

According to still another embodiment of the invention, the packing sheet wherein the concavo-convex structure is prepared by using a material comprising particles having a diameter of 1 to 100 $\mu$m dispersed in a binder resin is used in the above-described plate-attaching method. The effect of preventing plate slippage and the prevention of stain occurrence in the non-image area can be simultaneously achieved.

According to a further embodiment of the invention, a guide member that holds the printing plate prior to and during the attaching operation on the plate cylinder is used in the above-described plate-attaching method. By adopting such an embodiment, the printing plate can be prevented from hanging down owing to the low stiffness thereof because it is held by the guide member. Accordingly, the operator is liberated from the need of manual plate holding, and the printing plate-attaching operation is simplified.

Moreover, since the need of pulling the plate rear end is eliminated, the elongation of printing plate is effectively suppressed.

According to a still further embodiment of the invention, the apparatus further comprising a rotating member for rotating the plate cylinder when the printing plate is attached on the plate cylinder, a detecting member for detecting the rotational position of the plate cylinder, a rotation controlling member for controlling the rotation and stopping of the plate cylinder rotating member at pre-determined positions according to signals from the member for detecting the rotational position, a driving member for driving the pressure member so as to be brought into contact with or separated from the plate cylinder, and a controlling member for controlling the driving member at pre-determined positions according to signals from the member for detecting the rotational position.

According to the embodiment, the operator need not conduct the rotation and stopping of the plate cylinder as well as the contact and separation of the pressure member with respect to the plate cylinder, which are required for attaching the printing plate on the plate cylinder. Thus, not only the workload of the operator is further reduced, but also the printing plate can be rapidly attached on the plate cylinder.

The term "the maximum printing length in the rotational direction of the plate cylinder during the printing plate attaching operation" means the maximum length that can be printed on paper, and is described in the specification or instruction manual of a printing press in terms of a specified numerical value. In general, this length can be regarded as the length of region that expands along the diameter circumference of the plate cylinder from the vicinity of the ridge portion in the plate front end area to the vicinity of the ridge portion in the plate rear end area.

As the pressure member, for example, a roller-shaped pressure member, which is driven by a driving member so as to be come into contact with and be separated from the plate cylinder, can be used. Also, a planar pressure member, for example, a pad-shaped or brush-shaped pressure member, which is driven by a driving member so as to be come into contact with and be separated from the plate cylinder.

As the registration pin, for example, that provided on the upper surface of the lower tooth in the plate front end clamping mechanism protruding toward the upper tooth, that provided on the lower surface of the upper tooth in the plate front end clamping mechanism protruding toward the lower tooth, or that integrally provided on the plate cylinder can be employed.

As the plate rear end fixing mechanism, a plate rear end clamping mechanism having an upper tooth and a lower tooth can be used. Also, a plate rear end holding mechanism using a plate spring-shaped member may be used. Further, a method of adhering onto the plate cylinder surface or the plate rear end clamping member using, for example, a double-faced adhesive tape or spray paste may be employed.

Japanese Patent Laid-Open No. 24555/1998 discloses a method and an apparatus for positioning and fixing the plate front end of a flexible printing plate by means of three or more reference pins. The fixing method and apparatus employ a mechanism in which the reference pins are provided on the upper surface of an upper tooth thereof, and the reference pins are engaged with reference holes of a printing plate, thereby positioning and fixing the printing plate. On the other hand, in the present invention, the reference pins are provided between the upper and lower teeth of the plate front end clamping mechanism and used for contact with a printing plate or a pin contact member, and the fixation of the plate front end is conducted by the plate front end clamping mechanism. As described above, the configuration of the apparatus and the function of the reference pins in the method and apparatus described in Japanese Patent Laid-Open No. 24555/1998 are different from those in the invention. Moreover, in Japanese Patent Laid-Open No. 24555/1998, the technical idea of the invention that the flexible printing plate is wound onto the plate cylinder while it is pressed toward the entire outer peripheral surface of the plate cylinder by means of the pressure member is not disclosed.

Further, Registered Japanese Utility Model No. 3014242 discloses a printing plate-attaching apparatus equipped with a plate pressure roller that presses a flexible printing plate onto a plate cylinder. However, in the Registered Japanese Utility Model, the technical idea of the invention that the plate front end of the flexible printing plate is brought into contact with three or more registration pins, or the plate front end of the printing plate is fixed to the pin contact member having higher rigidity than the printing plate and then the pin contact member is brought into contact with the registration pins, in order to prevent the deformation of the plate front end of the printing plate is not disclosed.

A plate rear end clamping mechanism of the printing plate-attaching apparatus disclosed in the Registered Japanese Utility Model has a structure in which the plate rear end of printing plate is held and then pulled. Therefore, the technical idea of the invention that the tension is not positively applied to the printing plate is not disclosed in the Registered Japanese Utility Model.

Embodiments of the invention will be described in more detail below with reference to the accompanying drawings. The members or parts, which have been already described regarding the conventional methods and apparatus, are given the same or corresponding designations in the drawings and the description thereof is simplified or omitted here.

Figure 2:
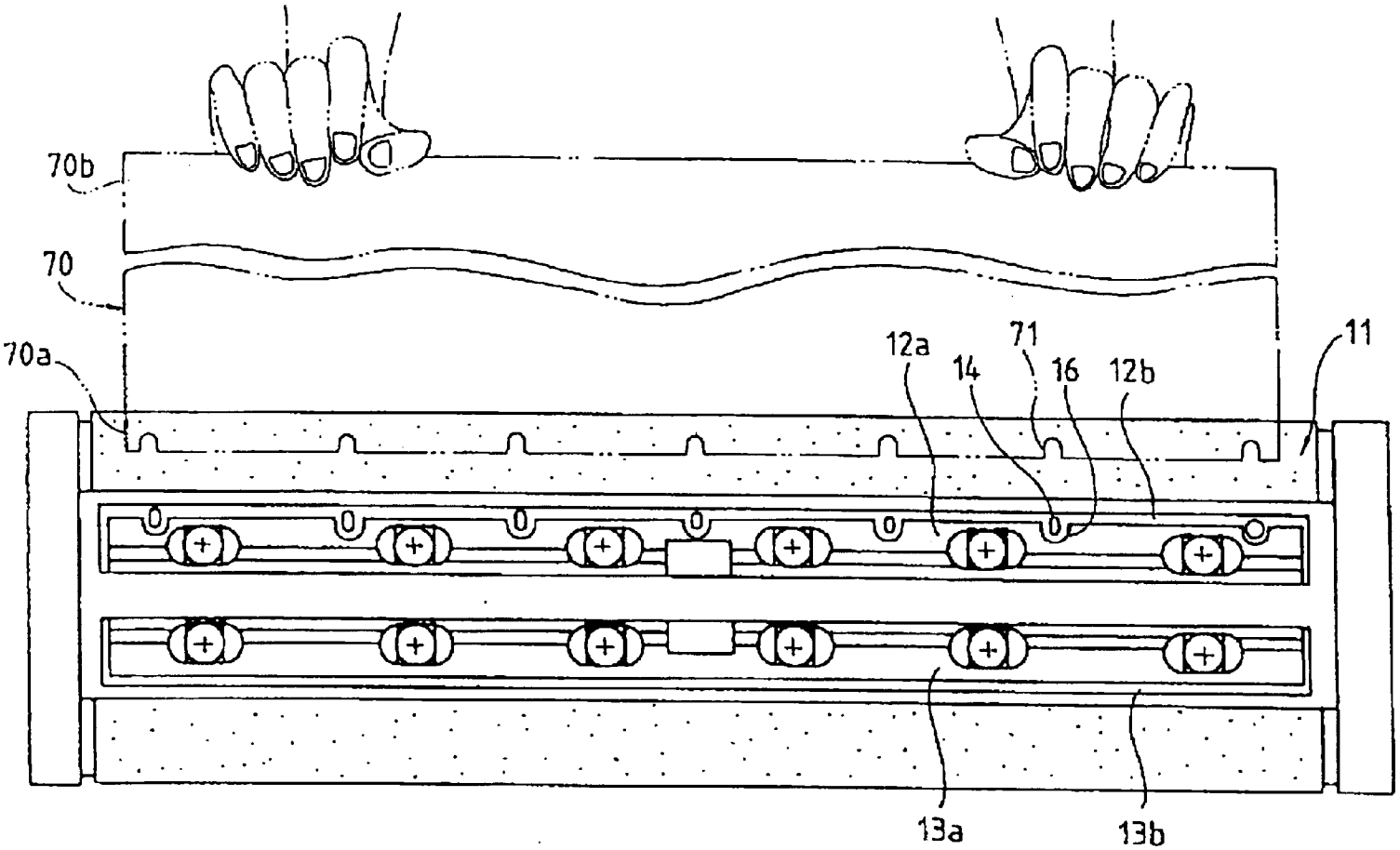
FIG. 2 is a view taken from the direction of the arrow X shown in FIG. 1.

FIG. 1 is a schematic view showing a first embodiment of the invention. Specifically, FIG. 1 shows a printing plate-attaching unit 10 for attaching a flexible printing plate (made of polyester) 70 on one of plate cylinders 11 provided in a printing press 50 for multi-color (four-color) printing. FIG. 2 is a view of the unit 10 taken from the direction of the arrow X shown in FIG. 1, showing the plate cylinder 11 according to the present embodiment.

As shown in FIG. 1, the plate-attaching unit 10 comprises the plate cylinder 11 having a plate front end clamping mechanism 12 and a plate rear end clamping mechanism 13, a pressure roller 17 and a blanket cylinder 25, each of which is capable of being contacted with and separated from the outer peripheral surface 11*b* of the plate cylinder 11, and a guide member 20 which guides the plate front end of the printing plate 70 to the plate front end clamping mechanism 12. The plate cylinder 11 is rotated and stopped by means of a control member (not shown). The control member is equipped with a member for detecting the rotational position of the plate cylinder.

The guide member 20 is structured by disposing a guide roller 23 at the tip of each of an appropriate number (two in the figure) of support members 22 provided on and protruding from a plate-shaped member 21. As the plate-shaped member 21, a cover plate that covers the side surface of the printing press 50 is used here.

The blanket cylinder 25 is arranged such that it can be contacted with and separate from the plate cylinder 11 and thus, when the printing plate 70 is wound onto the plate cylinder 11, printing plate 70 can be held under pressure between the blanket cylinder and the plate cylinder. Close to the contact point of the plate cylinder 11 with the blanket cylinder 25 is arranged a hand cover 26 having a roughly L-shaped cross-section on the side (the left side in the figure) from which the printing plate 70 is inserted (left side in the figure). The hand cover 26 prevents an operator from being accidentally caught his finger between the blanket cylinder 25 and the plate cylinder 11.

Figure 4:
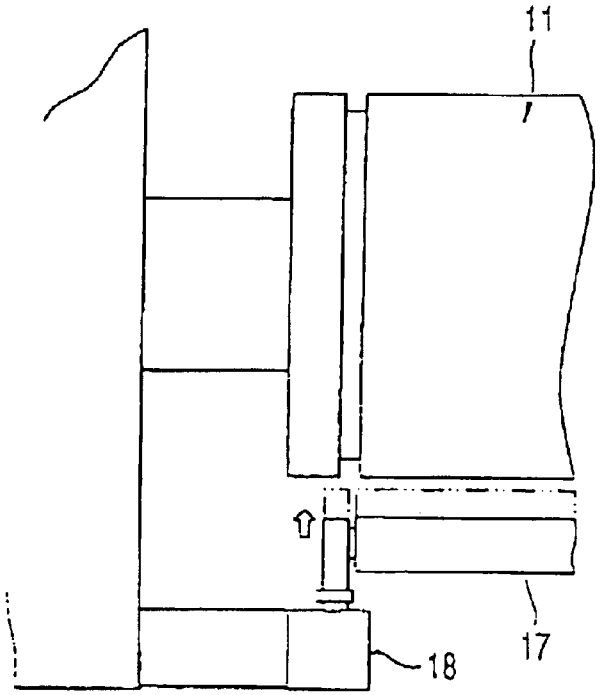
FIG. 4 is a view showing a pressing roller used in the first embodiment of the invention.

As shown in FIG. 4, the pressure roller 17 is assembled to an appropriate driving member such as a cylinder 18 and is structured such that it can be contacted with and separated from the outer peripheral surface of the plate cylinder 11 by a control member (not shown). The pressure roller 17 is preferably made of an elastic material such as rubber so as not to damage the flexible printing plate.

As shown in FIG. 2, on the upper surface of a bottom tooth 12*b* in the plate front end clamping mechanism, three or more (seven in the figure) registration pins 14 are protrusively provided in the axial direction of the plate cylinder 11 with a pre-determined spacing between the adjacent pins. Among these registration pins 14, only one registration pin shown on the right in FIG. 2 has a circular cross-section, and the other remaining registration pins 14 have a cross-section resulting from cutting off the both sides of the circular cross-section of the registration pins in the direction perpendicular to that of the plate cylinder axis in such a manner that the width of the remaining registration pins in the direction of the plate cylinder axis is narrower than the width of the above-described circular registration pin in the plate cylinder axis.

In appropriate positions of the upper tooth 12*a* and in appropriate positions of the plate front end 70*a* of the printing plate, both corresponding to the positions of the registration pins 14, notches 16 and 71 are formed, respectively.

Figure 3:
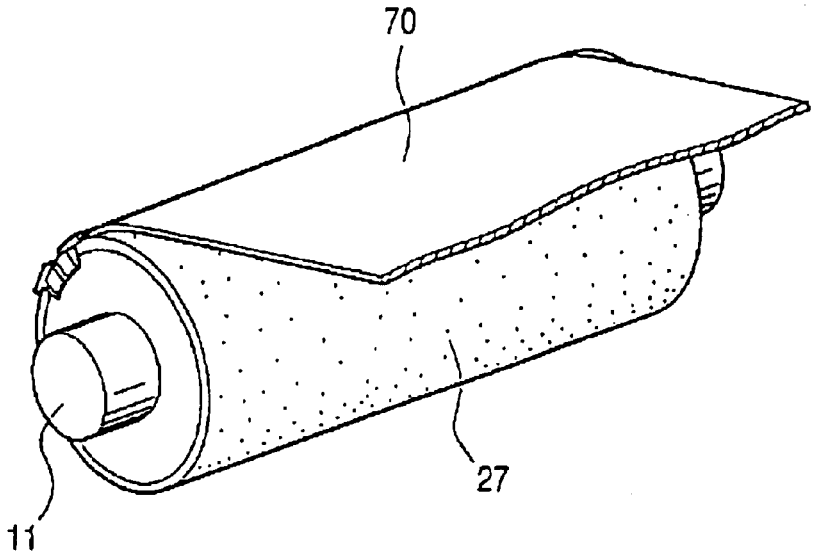
FIG. 3 is a view showing a packing sheet wound around a plate cylinder used in the first embodiment of the invention.

Around the plate cylinder 11 is wound and fixed a packing sheet having a concavo-convex structure at least on one surface thereof in such a manner that the concavo-convex surface is faced to the above-described printing plate, as shown in FIG. 3.

Now, the packing sheet will be described in detail below.

As a substrate for the packing sheet, for example, a metal plate, a resin sheet or a metal-resin composite sheet is used. Preferred examples of the substrate include metal plates such as aluminum, zinc, titanium and stainless steel plates, bimetal plates such as copper-aluminum, copper-stainless steel and chromium-copper plates, tri-metal plates such as chromium-copper-aluminum, chromium-lead-iron and chromium-copper-stainless steel plates, resin sheets such as PET, PE, PP, polyester, polyimide, polyamide and acrylic resin sheets, metal-resin composite sheets such as aluminum-PET, aluminum-PE, aluminum-polyester, titanium-PET and titanium-PE sheets. Still more preferable substrates include metal plates such as aluminum and stainless steel plates, resin sheets such as PET and PE sheets, and metal-resin composite sheets such as aluminum-PET and aluminum-polyester sheets. The substrate is preferably a sheet-shaped material having an initial modulus of elasticity not lower than 350 kgf/mm$^2$. With the use of such a substrate, the concavo-convex structure of the packing sheet effectively functions without being flattened by printing pressure. The thickness of the substrate is appropriately from 50 to 250 $\mu$m. The initial modulus of elasticity can be measured according to JIS K7127.

In order to form a concavo-convex surface on the substrate of the packing sheet, a method of coating and drying a dispersion comprising a binder resin having dispersed therein particles, a method of forming a binder resin film on the surface and then pushing particles into the binder resin film by mechanical pressure, a thermal spray method spraying a melted metal, a surface-blasting method, a gravure coating method of a cross-linkable resin and a laser processing method may be employed. Among these, the method of coating a dispersion comprising a binder resin having dispersed therein particles and the method of forming a binder resin film on the surface and then pushing particles into the binder resin film by mechanical pressure are preferred.

The particles used for the formation of the concavo-convex surface described above preferably have a particle diameter of from 1 to 100 $\mu$m, more preferably from 1 to 80 $\mu$m and particularly preferably from 1 to 50 $\mu$m. The material of the particles is not specifically restricted, and particles of inorganic, organic and organic-inorganic composite materials can be used. Particles having a hardness larger than that of the rear surface of support of the printing plate are preferably used.

As the inorganic particles, e.g., metallic powder, and particles of metal oxide, metal nitride, metal hydroxide, metal sulfide, metal carbide and composite metallic compounds thereof are exemplified. Particles of oxides such as glass, $SiO_2$, $TiO_2$, ZnO, $Fe_2O_3$, $ZrO_2$ and $SnO_2$, and sulfides such as ZnS and CuS are preferably used.

As the organic particles, e.g., synthetic resin particles and natural polymer particles can be exemplified. Preferably particles of acrylic resin, polyethylene, polypropylene, poly (ethylene oxide), poly(propylene oxide), polyethyleneimine, polystyrene, polyurethane, polyurea, polyester, polyamide, polyimide, carboxymethylcellulose, gelatin, starch, chitin and chitosan, and more preferably synthetic resin particles such as acrylic resin, polyethylene, polypropylene and polystyrene are exemplified.

As the organic-inorganic composite particles, e.g., particles of composites of two or more of the materials forming the above-described inorganic and organic particles can be exemplified. Preferably particles of composites of oxide such as glass, $SiO_2$, $TiO_2$, ZnO, $Fe_2O_3$, $ZrO_2$ and $SnO_2$ and/or sulfide such as ZnS and CuS with acrylic resin, polyethylene, polypropylene, poly(ethylene oxide), poly (propylene oxide), polyethyleneimine, polystyrene, polyurethane, polyurea, polyester, polyamide, polyimide, carboxymethylcellulose, gelatin, starch, chitin and chitosan are exemplified. More preferably, particles of composites of oxide such as $SiO_2$, $TiO_2$, ZnO, $Fe_2O_3$, $ZrO_2$ and $SnO_2$ with acrylic resin, poly(ethylene oxide), poly(propylene oxide), polyethyleneimine, polyurethane, polyurea, polyester, polyamide, polyimide, carboxymethylcellulose, gelatin, starch, chitin and chitosan, each having a functional group capable of forming a hydrogen bond, are exemplified.

In the invention, as the binder resin which disperses and binds such particles forming the concavo-convex surface, any natural, semi-synthetic and synthetic resins, e.g., conventionally used organic resins (oleophilic resins and water-soluble resins), organic resin emulsions, inorganic resins and organic-inorganic hybrid resins can be used. The resins may be used in a cross-linked form, if desired.

As the oleophilic organic resin, acrylic resins (poly (methyl methacrylate), poly (methyl acrylate), poly(ethyl methacrylate), copolymers of various alkyl, aralkyl or aryl acrylates, copolymers of various alkyl, aralkyl or aryl methacrylates), alkyd resins (melamine resins and phenol resins), polystyrene resins, poly(vinyl acetate) resins, epoxy resins, polyalkylene resins (polyethylene and polypropylene), polyester resins and polyurethane resins can be exemplified.

As the water-soluble organic resin, cellulose, cellulose derivatives (cellulose esters including cellulose nitrate, cellulose sulfate, cellulose acetate, cellulose propionate, cellulose succinate, cellulose butyrate, cellulose acetate succinate, cellulose acetate butyrate and cellulose acetate phthalate; and cellulose ethers including methyl cellulose, ethyl cellulose, cyanoethyl cellulose, carboxymethyl cellulose, hydroxyethyl cellulose, hydroxypropyl cellulose, ethyl hydroxyethyl cellulose, hydroxypropyl methyl cellulose and carboxymethyl hydroxyethyl cellulose), starch, starch derivatives (e.g., oxidized starch, esterified starches such as those esters with nitric acid, sulfuric acid, phosphoric acid, acetic acid, propionic acid, butyric acid and succinic acid, and etherized starches such as those resulting from methylation, ethylation, cyanoethylation, hydroxyalkylation and carboxymethylation), alginic acid, pectin, carrageenan, tamarind gum, natural rubbers (e.g., gum arabic, guar gum, locust bean gum, tragacant gum and xanthane gum), pullulan, dextran, casein, gelatin, chitin, chitosan, poly(vinyl alcohol), poly(alkylene glycol) [e.g., poly(ethylene glycol), poly(propylene glycol) and ethylene-propylene glycol copolymers], allyl alcohol copolymers, acrylic acid copolymers, methacrylic acid copolymers, poly(amino acid) s, polyamides (e.g., polymers or copolymers of an N-substituted acrylamide or N-substituted methacrylamide [the N-substituent including, for example, methyl, ethyl, propyl, isopropyl, butyl, phenyl, monomethylol, 2-hydroxyethyl, 3-hydroxypropyl, 1,1-bis (hydroxymethyl) ethyl or 2,3,4,5,6-pentahydroxypentyl group]), polyamines (e.g., polyethyleneimine, polyallylamine and polyvinylamine), and polyurea (e.g., urea resin) are included.

As the organic resin emulsion, acrylic resin [e.g., poly (methyl methacrylate), poly (methyl acrylate), poly(ethyl methacrylate), copolymers of various alkyl, aralkyl or aryl acrylates and copolymers of various alkyl, aralkyl or aryl methacrylates] emulsions, alkyd resin (e.g., melamine resin and phenol resin) emulsions, styrene resin emulsions, vinyl acetate resin emulsions, epoxy resin emulsions, alkylene resin (e.g., polyethylene and polypropylene) emulsions, ester resin emulsions and urethane resin emulsions are included.

As the inorganic resin, a resin containing a bond comprising a metal atom connected via oxygen or nitrogen atom (hereinafter referred to as a metal-containing resin) is included. The metal-containing resin means a polymer which mainly contains a bond comprising "oxygen (nitrogen) atom-metal atom-oxygen (nitrogen) atom".

Among the metal-containing resins, polymers containing the bond of oxygen atom-metal atom-oxygen atom are preferably those obtained by the hydrolysis polycondensation of a metallic compound represented by formula (I) shown below. The hydrolysis polycondensation described herein is a reaction wherein a reactive group is repeatedly subjected to hydrolysis and condensation under an acidic or basic condition to conduct polymerization.

$$(R^0)_n M\,(Y)_{x-n} \qquad \text{(I)}$$

wherein $R^0$ represents a hydrogen atom, a hydrocarbon group or a heterocyclic group; Y represents a reactive group; M represents a metal atom having a valence of from 3 to 6; x represents a valence of the metal atom M; and n represents 0, 1, 2, 3 or 4, provided that the balance of x−n is not less than 2.

Now, the metallic compound represented by formula (I) will be described in detail below.

In formula (I), $R^0$ represents a straight chain or branched chain alkyl group having from 1 to 12 carbon atoms (e.g., methyl, ethyl, propyl, butyl, pentyl, hexyl, heptyl, octyl, nonyl, decyl, or dodecyl group) which may have one or more substituents including, for example, a halogen atom (e.g., chlorine, fluorine or bromine atom), a hydroxy group, a thiol group, a carboxy group, a sulfo group, a cyano group, an epoxy group, an —OR' group (wherein R' represents a hydrocarbon group, e.g., methyl, ethyl, propyl, butyl, hexyl, heptyl, octyl, decyl, propenyl, butenyl, hexenyl, octenyl, 2-hydroxyethyl, 3-chloropropyl, 2-cyanoethyl, N,N-dimethylaminoethyl, 2-bromoethyl, 2-(2-methoxyethyl) oxyethyl, 2-methoxycarbonylethyl, 3-carboxypropyl or benzyl group), an —OCOR' group, a —COOR' group, a —COR' group, an —N(R")(R") group (wherein two R"s, which may be the same or different, each represent a hydrogen atom or a group having the same meaning as previously defined for R'), an —NHCONHR' group, an —NHCOOR' group, a —$Si(R')_3$ group, a —CONHR" group or an —NHCOR' group; a straight chain or branched chain alkenyl group having from 2 to 12 carbon atoms (e.g., vinyl, propenyl, butenyl, pentenyl, hexenyl, octenyl, decenyl, or dodecenyl group) which may have one or more substituents selected from those described for the above-described alkyl group; an aralkyl group having from 7 to 14 carbon atoms (e.g., benzyl, phenetyl, 3-phenylpropyl, naphthylmethyl or 2-naphthylethyl group) which may have one or more substituents selected from those described for the above-described alkyl group; an alicyclic group having from 5 to 10 carbon atoms (e.g., cyclopentyl, cyclohexyl, 2-cyclohexylethyl, 2-cyclopentylethyl, norbornyl or adamantyl group) which may have one or more substituents selected from those described for the above-described alkyl group; an aryl group having from 6 to 12 carbon atoms (e.g., phenyl or naphthyl group) which may have one or more substituents selected from those described for the above-described alkyl group; or a heterocyclic group containing at least one atom selected from a nitrogen atom, an oxygen atom and a sulfur atom (examples of the hetero ring including pyran, furan, thiophene, morpholine, pyrrole, thiazole, oxazole, pyridine, piperidine, pyrrolidone, benzothiazole, benzoxazole, quinoline or tetrahydrofuran ring), which may have a condensed ring and which may have one or more substituents selected from those described for the above-described alkyl group.

The reactive group represented by Y preferably includes a hydroxy group, a halogen atom (e.g., fluorine, chlorine, bromine or iodine atom), an —$OR^1$ group, an —$OCOR^2$ group, a —CH ($COR^3$) ($COR^4$) group, a —CH ($COR^3$) ($COOR^4$) group or an —N ($R^5$) ($R^6$) group.

In the —$OR^1$ group, $R^1$ represents an aliphatic group having from 1 to 10 carbon atoms which may be substituted (e.g., methyl, ethyl, propyl, butyl, pentyl, hexyl, heptyl, octyl, nonyl, decyl, propenyl, butenyl, heptenyl, hexenyl, octenyl, decenyl, 2-hydroxyethyl, 2-hydroxypropyl, 2-methoxyethyl, 2-(methoxyethyloxy)ethyl, 2-(N,N-diethylamino)ethyl, 2-methoxypropyl, 2-cyanoethyl, 3-methyloxypropyl, 2-chloroethyl, cyclohexyl, cyclopentyl, cyclooctyl, chlorocyclohexyl, methoxycyclohexyl, benzyl, phenethyl, dimethoxybenzyl, methylbenzyl or bromobenzyl group).

In the —$OCOR^2$ group, $R^2$ preferably represents an aliphatic group having the same meaning as defined for $R^1$; and more preferably represents an aliphatic group or an aromatic group having from 6 to 12 carbon atoms which may be substituted (e.g., an aryl group having the same meaning as defined for $R^0$ described above).

In the —CH($COR^3$) ($COR^4$) group and the —CH($COR^3$) ($COOR^4$) group, $R^3$ represents an alkyl group having from 1 to 4 carbon atoms (e.g., methyl, ethyl, propyl or butyl group) or an aryl group (e.g., phenyl, tolyl or xylyl group); and $R^4$ represents an alkyl group having from 1 to 6 carbon atoms (e.g., methyl, ethyl, propyl, butyl, pentyl or hexyl group), an aralkyl group having from 7 to 12 carbon atoms (e.g., benzyl, phenethyl, phenylpropyl, methylbenzyl, methoxybenzyl, carboxybenzyl or chlorobenzyl group) or an aryl group (e.g., phenyl, tolyl, xylyl, mesityl, methoxyphenyl, chlorophenyl, carboxyphenyl or diethoxyphenyl group).

In the —N($R^5$) ($R^6$) group, $R^5$ and $R^6$, which may be the same or different, each represent a hydrogen atom or an aliphatic group having from 1 to 10 carbon atoms which may be substituted (e.g., an aliphatic group having the same meaning as defined for $R^1$ in the above-described —$OR^1$ group). More preferable groups are those in which the sum of the carbon atoms in $R^5$ and $R^6$ does not exceed 12.

The metal atom represented by M includes preferably those belonging to transition metals, rare earth metals and metals of III to V groups of the periodic table. More preferred metal atoms include Al, Si, Sn, Ge, Ti and Zr, and still more preferred metal atoms include Al, Si, Sn, Ti and Zr. Particularly, Si is preferred.

Specific examples of the metallic compound represented by formula (I) are set forth below, but the invention should not be construed as being limited thereto.

Methyltrichlorosilane, methyltribromosilane, methyltrimethoxysilane, methyltriethoxysilane, methyltriisopropoxysilane, methyltri(t-butoxy)silane, ethyltrichlorosilane, ethyltribromosilane, ethyltrimethoxysilane, ethyltriethoxysilane, ethyltriisopropoxysilane, ethyltri(t-butoxy)silane, n-propyltrichlorosilane, n-propyltribromosilane, n-propyltrimethoxysilane, n-propyltriethoxysilane, n-propyltriisopropoxysilane, n-propyltri(t-butoxy)silane, n-hexyltrichlorosilane, n-hexyltribromosilane, n-hexyltrimethoxysilane, n-hexyltriethoxysilane, n-hexyltriisopropoxysilane, n-hexyltri(t-butoxy)silane, n-decyltrichlorosilane, n-decyltribromosilane, n-decyltrimethoxysilane, n-decyltriethoxysilane, n-decyltriisopropoxysilane, n-decyltri(t-butoxy)silane, n-octadecyltrichlorosilane, n-octadecyltribromosilane, n-octadecyltrimethoxysilane, n-octadecyltriethoxysilane, n-octadecyltriisopropoxysilane, n-octadecyltri(t-butoxy)silane, phenyltrichlorosilane, phenyltribromosilane, phenyltrimethoxysilane, phenyltriethoxysilane, phenyltriisopropoxysilane, phenyltri(t-butoxy)silane, tetrachlorosilane, tetrabromosilane, tetramethoxysilane, tetraethoxysilane, tetraisopropoxysilane, tetrabutoxysilane, dimethoxydiethoxysilane, dimethyldichlorosilane, dimethyldibromosilane, dimethyldimethoxysilane, dimethyldiethoxysilane, diphenyldichlorosilane, diphenyldibromosilane, diphenyldimethyoxysilane, diphenyldiethoxysilane, phenylmethyldichlorosilane, phenylmethyldibromosilane, phenylmethyldimethoxysilane, phenylmethyldiethoxysilane, triethoxyhydrosilane, tribromohydrosilane, trimethoxyhydrosilane, isopropoxyhydrosilane, tri(t-butoxy)hydrosilane, vinyltrichlorosilane, vinyltribromosilane, vinyltrimethoxysilane, vinyltriethoxysilane, vinyltriisopropoxysilane, vinyltri(t-butoxy)silane, trifluoropropyltrichlorosilane, trifluoropropyltribromosilane, trifluoropropyltrimethoxysilane, trifluoropropyltriethoxysilane, trifluoropropyltriisopropoxysilane, trifluoropropyltri(t-butoxy)silane, γ-glycidoxypropylmethyldimethoxysilane, γ-glycidoxypropylmethyldiethoxysilane, γ-glycidoxypropyltrimethoxysilane, γ-glycidoxypropyltriethoxysilane, γ-glycidoxypropyltriisopropoxysilane, γ-glycidoxypropyltri(t-butoxy)silane, γ-methacryloxypropylmethyldimethoxysilane, γ-methacryloxypropylmethyldiethoxysilane, γ-methacryloxypropyltrimethoxysilane, γ-methacryloxypropyltriisopropoxysilane, γ-methacryloxypropyltri(t-butoxy)silane, γ-aminopropylmethyldimethoxysilane, 7-aminopropylmethyldiethoxysilane, γ-aminopropyltrimethoxysilane, γ-aminopropyltriethoxysilane, γ-aminopropyltriisopropoxysilane, γ-aminopropyltri(t-butoxy)silane, γ-mercaptopropylmethyldimethoxysilane, γ-mercaptopropylmethyldiethoxysilane, γ-mercaptopropyltrimethoxysilane, γ-mercaptopropyltriethoxysilane, γ-mercaptopropyltriisopropoxysilane, γ-mercaptopropyltri(t-butoxy)silane, β-(3,4-epoxycyclohexyl)ethyltrimethoxysilane, β-(3,4-epoxycyclohexyl)ethyltriethoxysilane, $Ti(OR)_4$ (wherein R represents, e.g., methyl, ethyl, propyl, butyl, pentyl or hexyl group), $TiCl_4$, $Zn(OR)_2$, $Zn(CH_3COCHCOCH_3)_2$, $Sn(OR)_4$, $Sn(CH_3COCHCOCH_3)_4$, $Sn(OCOR)_4$, $SnCl_4$, $Zr(OR)_4$, $Zr(CH_3COCHCOCH_3)_4$ and $Al(OR)_3$.

The metallic compounds described above can be used individually or in combination thereof for the production of a metal-containing resin.

Polysilazanes are examples of the metal-containing resin having a bond of nitrogen atom-metal atom-nitrogen atom.

Moreover, in the invention, it is preferred to use a composite material comprising the above-described metal-containing resin and an organic polymer containing a group capable of forming a hydrogen bond with the metal-containing resin. The term "composite material comprising the metal-containing resin and the organic polymer" used herein means and includes both a sol substance and a gel substance.

The organic polymer described above contains a group capable of forming a hydrogen bond with the metal-containing resin. The group is also referred to as a specific bonding group hereinafter. The specific bonding group preferably includes an amido bond (including a carbonamido bond and a sulfonamido bond), a urethane bond and a ureido bond and a hydroxy group.

The organic polymer contains at least one specific bonding group in the main chain and/or the side chain thereof as a repeating unit component. The organic polymer preferably includes a polymer containing, as a repeating unit component, a component having at least one bond selected from —N($R^{11}$)CO—, —N ($R^{11}$)$SO_2$—, —NHCONH— and —NHCOO— in the main chain or side chain thereof, and/or a polymer containing, as a repeating unit component, a component having a hydroxy group. In the above-described amido bonds, $R^{11}$ represents a hydrogen atom or an organic residue, and the organic residue includes the hydrocarbon group and heterocyclic group represented by $R^0$ in formula (I).

The organic polymer containing the specific bond in its main chain according to the invention includes an amide resin having the —N($R^{11}$)CO— or —N($R^{11}$)$SO_2$— bond, a ureido resin having the —NHCONH— bond and a urethane resin having the —NHCOO— bond.

As diamines and dicarboxylic acids used for the preparation of the amide resins, diisocyanates used for the preparation of the ureido resins and diols used for the preparation of the urethane resins, compounds described, for example, in the Society of Polymer Science, Japan ed., *Kobunshi Data Handbook—Kisohen—* (Polymer Data Handbook, Fundamental Volume), Chapter I, Baifukan Co., Ltd. (1986), and Shinzo Yamashita and Tosuke Kaneko ed., *Kakyozai Handbook* (Handbook of Cross-linking Agents), Taiseisha Co., Ltd. (1981), can be used.

Other examples of the polymer containing the amido bond include a polymer containing a repeating unit represented by formula (II) shown below, an N-acylated polyalkyleneimine, and polyvinylpyrrolidone and a derivative thereof.

(II)

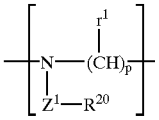

In formula (II), $Z^1$ represents —CO—, —$SO_2$— or —CS—; $R^{20}$ represents the same groups as those defined for $R^0$ in formula (I); $r^1$ represents a hydrogen atom or an alkyl group having from 1 to 6 carbon atoms (e.g., methyl, ethyl, propyl, butyl, pentyl or hexyl group), $r^1$'s may be the same or different; and p represents an integer of 2 or 3.

Among the polymers containing a repeating unit represented by formula (II), a polymer wherein $Z^1$ represents a —CO— bond and p is 2 can be obtained by ring-opening polymerization of an oxazoline, which may be substituted, in the presence of a catalyst. The catalyst which can be used includes a sulfuric acid ester or sulfonic acid ester (e.g., dimethyl sulfate or an alkyl p-toluenesulfonate); an alkyl halide (e.g., an alkyl iodide such as methyl iodide); a fluorinated metallic compound of Friedel-Crafts catalysts; and an acid (e.g., sulfuric acid, hydrogen iodide or p-toluenesulfonic acid) or an oxazolinium salt thereof formed from the acid and the oxazoline. The polymer may be a homo-polymer or a copolymer. Furthermore, the polymer may be a graft-copolymer resulting from grafting of the polymer to other polymer.

Specific examples of the oxazoline include 2-oxazoline, 2-methyl-2-oxazoline, 2-ethyl-2-oxazoline, 2-propyl-2-oxazoline, 2-isopropyl-2-oxazoline, 2-butyl-2-oxazoline, 2-dichloromethyl-2-oxazoline, 2-trichloromethyl-2-oxazoline, 2-pentafluoroethyl-2-oxazoline, 2-phenyl-2-oxazoline, 2-methoxycarbonylethyl-2-oxazoline, 2-(4-methylphenyl)-2-oxazoline, and 2-(4-chlorophenyl)-2-oxazoline. Preferred examples of the oxazoline include 2-oxazoline, 2-methyl-2-oxazoline and 2-ethyl-2-oxazoline. The oxazoline polymers may be employed individually or as a mixture of two or more thereof.

Other polymers containing a repeating unit represented by formula (II) are also obtained in the same manner as described above except that thiazoline, 4,5-dihydro-1,3-oxazine or 4,5-dihydro-1,3-thiazine is used in place of the oxazoline.

The N-acylated polyalkyleneimine includes a carboxylic acid amide compound containing an —N(CO—$R^{20}$)— bond obtained by a polymer reaction of a polyalkyleneimine with a carboxylic halide, and a sulfonamide compound containing an —N($SO_2$—$R^{20}$)— bond obtained by a polymer reaction of a polyalkyleneimine with a sulfonyl halide. $R^{20}$ herein has the same meaning as $R^{20}$ in formula (II) described previously.

The organic polymer containing the specific bonding group in the side chain thereof includes a polymer containing, as the main component, a component having at least one bond selected from the specific bonding groups described above. Such components include, for example, repeating units derived from acrylamide, methacrylamide, crotonamide and vinyl acetamide, and the repeating units shown below. However, the invention should not be construed as being limited thereto.

(1)

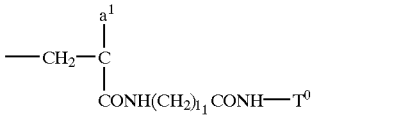

$a^1$: —H or —$CH_3$ $l_1$: an integer of from 1 to 4

$T^0$: —H, —$CH_3$

—$(CH_2)_2OCH_3$ or —$(CH_2)_2N(CH_3)_2$ (2)

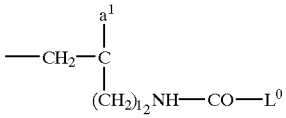

$l_2$: 0 or 1

$L^0$ = —$C_{n1}H_{2n1+1}$ (n: an integer of from 1 to 4),

—$(CH_2)_2OCH_3$, —$(CH_2)_3N(CH_3)_2$

—$CH_2C_6H_5$ or —$(CH_2)_{n1}OH$ (3)

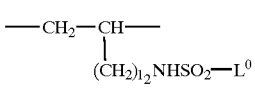

-continued (4)

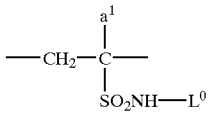

(5)

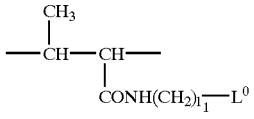

(6)

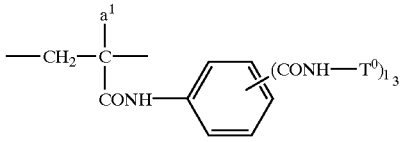

$l_3$: 0, 1 or 2

(7)

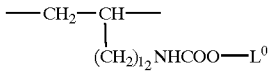

(8)

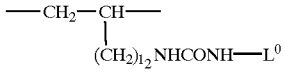

(9)

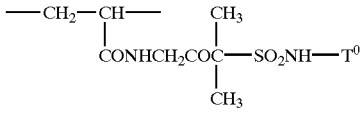

(10)

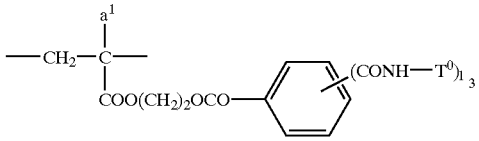

(11)

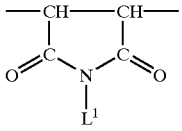

$L^1$: —H, —$L^0$ or —$(CH_2)_{l_1}$—$CONH_2$ (12)

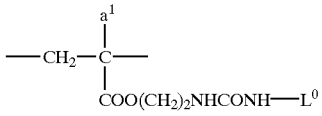

(13)

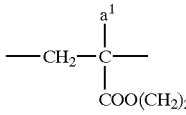

(14)

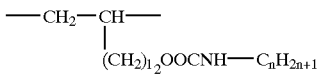

(15)

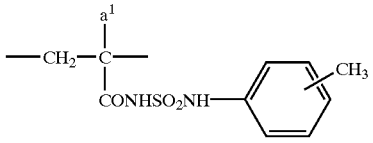

-continued (16)

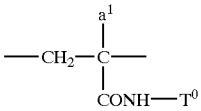

The organic polymer containing a hydroxy group may be any of natural water-soluble polymers, semi-synthetic water-soluble polymers and synthetic polymers, and include those described, for example, in Munio Kotake supervised, *Daiyuukikagaku 19-Tennen Koubunshi Kagoubutsu I* (Grand Organic Chemistry—Natural High Molecular Weight Compounds I), Asakura Shoten (1960), Keiei Kaihatsu Center Shuppanbu ed., *Suiyousei Koubunshi●Mizu-bunsan-gata Jushi Sougou Gijutsu Shiryo-shuu* (Water-Soluble Polymers●Aqueous Dispersion Type Resins: Collective Technical Data), Keiei Kaihatsu Center Shuppanbu (1981), Shinji Nagatomo, *Shin-Suiyousei Polymer no Ouyou to Shijo* (New Applications and Market of Water-Soluble Polymers), CMC (1988), and *Kinousei Cellulose no Kaihatsu* (Development of Functional Cellulose), CMC (1985).

Specific examples of the natural and semi-synthetic polymers include cellulose, cellulose derivatives (e.g., cellulose esters including cellulose nitrate, cellulose sulfate, cellulose acetate, cellulose propionate, cellulose succinate, cellulose butyrate, cellulose acetate succinate, cellulose acetate butyrate and cellulose acetate phthalate; and cellulose ethers including methyl cellulose, ethyl cellulose, cyanoethyl cellulose, carboxymethyl cellulose, hydroxyethyl cellulose, hydroxypropyl cellulose, ethyl hydroxyethyl cellulose, hydroxypropyl methyl cellulose, and carboxymethyl hydroxyethyl cellulose), starch, starch derivatives (oxidized starch, esterified starches such as the esters with nitric acid, sulfuric acid, phosphoric acid, acetic acid, propionic acid, butyric acid and succinic acid, etherized starches such as those resulting from methylation, ethylation, cyanoethylation, hydroxyalkylation and carboxymethylation of starch), alginic acid, pectin, carrageenan, tamarind gum, natural rubbers (e.g., gum arabic, guar gum, locust bean gum, tragacant gum and xanthane gum), pullulan, dextran, casein, gelatin, chitin and chitosan.

Specific examples of the synthetic polymer include poly (vinyl alcohol), poly(alkylene glycol) [e.g., poly(ethylene glycol), poly(propylene glycol) and ethylene glycol-propylene glycol copolymers], allyl alcohol copolymers, homopolymers or copolymers of acrylate or methacrylate containing at least one hydroxy group (examples of the ester substituent including 2-hydroxyethyl, 3-hydroxypropyl, 2,3-dihydroxypropyl, 3-hydroxy-2-hydroxymethyl-2-methylpropyl, 3-hydroxy-2,2-di(hydroxymethyl)propyl, polyoxyethylene and polyoxypropylene groups), and homopolymers or copolymers of N-substituted acrylamide or methacrylamide containing at least one hydroxy group (examples of the N-substituent including monomethylol, 2-hydroxyethyl, 3-hydroxypropyl, 1,1-bis(hydroxymethyl) ethyl and 2,3,4,5,6-pentahydroxypentyl groups). However, the synthetic polymer is not particularly limited as long as it contains at least one hydroxy group in the side chain-substituent of the repeating unit thereof.

The weight average molecular weight of the organic polymer constituting the composite material for use in the invention is preferably from $1\times10^3$ to $1\times10^6$, more preferably from $5\times10^3$ to $4\times10^5$.

In the composite material comprising the metal—containing resin and the organic polymer of the invention, the ratio of the metal-containing resin to the organic polymer can be varied over a wide range, and a weight ratio of metal-containing resin/organic polymer is preferably from 10/90 to 90/10, and more preferably from 20/80 to 80/20.

The binder resin containing the above-described composite material forms a uniform organic/inorganic hybrid and is microscopically homogeneous without the occurrence of phase separation due to hydrogen bond formation between the hydroxyl group of the metal-containing resin and the above-described specific bonding group in the organic polymer, in a case where the metal-containing resin is, for example, obtained via the hydrolysis polycondensation of the metallic compound as described above. Also, when a hydrocarbon group is contained in the metal-containing resin, it is believed that the affinity between the metal-containing resin and the organic polymer is further enhanced due to the presence of the hydrocarbon group. Having inorganic and organic properties, the composite material described heretofore exhibits a strong interaction with both of inorganic and organic particles. Therefore, the particles are strongly adsorbed by the binder resin. Further, the composite material is excellent in film-forming property.

The composite material comprising the metal-containing resin and the organic polymer can be prepared by subjecting the metallic compound to hydrolysis polycondensation and then mixing with the organic polymer, or by conducting the hydrolysis polycondensation of the metallic compound in the presence of the organic polymer.

Preferably, the organic/inorganic polymer composite material can be prepared by conducting the hydrolysis polycondensation of the metallic compound in the presence of the organic polymer according to a sol-gel method. In the resulting organic/inorganic polymer composite material, the organic polymer is uniformly dispersed in the matrix (i.e., three-dimensional micro-network structure of an inorganic metal oxide) of the gel formed by the hydrolysis polycondensation of the metallic compound.

The sol-gel method preferably suited for the present purpose can be practiced according to any of conventionally well-known sol-gel methods. Specifically, it is conducted according to methods described in detail, for example, in *Sol-Gel-Ho ni-yoru Hakumaku Coating Gijutsu* (Thin Film Coating Technology by Sol-Gel Method), Gijutsu Joho Kyokai (1995), Sumio Sakihana, *Sol-Gel-Ho no Kagaku* (Science of Sol-Gel Method), Agne Shofusha (1988), and Seki Hirashima, *Saishin Sol-Gel-Ho ni-yoru Kinousei Hakumaku Sakusei Gijutsu* (Latest Technology of Functional Thin Film Formation by Sol-Gel Method), Sogo Gijutsu Center (1992).

The solvent used for the formation of the concavo-convex surface is appropriately selected from water and organic solvents. The organic solvent includes an alcohol (e.g., methanol, ethanol, propyl alcohol, ethylene glycol, diethylene glycol, propylene glycol, dipropylene glycol, ethylene glycol monomethyl ether, propylene glycol monomethyl ether and ethylene glycol monoethyl ether), an ether (e.g., tetrahydrofuran, ethylene glycol dimethyl ether, propylene glycol dimethyl ether and tetrahydropyran), a ketone (e.g., acetone, methyl ethyl ketone and acetylacetone), an ester (e.g., methyl acetate, ethylene glycol monomethyl monoacetate), an amide (e.g., formamide, N-methylformamide, pyrrolidone and N-methylpyrrolidone). The solvents may be used individually or in combination of two or more thereof.

In the use of the above-described composite material, it is preferable to use an acidic or basic catalyst for the purpose of accelerating the hydrolysis and polycondensation reaction of the above-described metallic compound represented by formula (I).

The catalyst is used in the form of an acidic or basic compound itself or a solution dissolved in a solvent such as water or an alcohol (hereinafter referred to as an acidic catalyst or a basic catalyst, respectively). The concentration of catalyst is not particularly limited, and the high catalyst concentration tends to increase the hydrolysis speed and the polycondensation speed. However, it is desirable that the basic catalyst concentration be not higher than 1N (mole/liter) (as the concentration in an aqueous solution), since the basic catalyst used in a high concentration sometimes causes precipitate formation in the sol solution.

The acidic catalyst or the basic catalyst-has no particular restriction as to the species. In the case where the use of a catalyst in a high concentration is required, however, a catalyst constituted of elements that do not substantially remain in the crystal grains of the catalyst after sintering is preferred. Specifically, suitable examples of the acidic catalyst include a hydrogen halide (e.g., hydrogen chloride), nitric acid, sulfuric acid, sulfurous acid, hydrogen sulfide, perchloric acid, hydrogen peroxide, carbonic acid, a carboxylic acid (e.g., formic acid or acetic acid), a substituted carboxylic acid represented by RCOOH wherein R represents a group substituted with another element or a group), and a sulfonic acid (e.g., benzenesulfonic acid). Suitable examples of the basic catalyst include an ammoniacal base (e.g., aqueous ammonia) and an amine (e.g., ethylamine or aniline).

The binder resin is used in an amount of usually from 8 to 50 parts by weight, preferably from 10 to 30 parts by weight based on 100 parts by weight of the particles. Within such a range, the effects of the invention are effectively exhibited.

Across-linking agent may also be used. The cross-linking agent includes various compounds usually used as a cross-linking agent. Specifically, compounds described, for example, in Shinzo Yamashita and Tousuke Kaneko ed., *Kakyou-zai Handbook* (Handbook on Cross-linking Agents), Taisei-sha (1981), and the Society of Polymer Science, Japan ed., *Koubunshi Data Handbook-Kisohen* (Polymer Data Handbook—Fundamental Volume), Baifukan (1986) can be used.

The cross-linking agents include, for example, ammonium chloride, a metal ion, an organic peroxide, a polyisocyanate compound (e.g., toluylenediisocyanate, diphenylmethanediisocyanate, triphenylmethanetriisocyanate, polymethylenephenylisocyanate, hexamethylenediisocyanate, isophoronediisocyanate or a high molecular polyisocyanate), a polyol compound (e.g., 1,4-butanediol, polyoxypropylene glycol, polyoxyethylene glycol or 1,1,1-trimethylolpropane), a polyamine compound (e.g., ethylenediamine, γ-hydroxypropylated ethylenediamine, phenylenediamine, hexamethylenediamine, N-aminoethylpiperazine or a modified aliphatic polyamine), a polyepoxy group-containing compound and an epoxy resin (e.g., compounds described, for example, in Hiroshi Kakiuchi ed., *Shin Epoxy Jyushi* (Hew Epoxy Resins), Shokodo (1985) and Kuniyuki Hashimoto ed., *Epoxy Jyushi* (Epoxy Resins), The Nikkan Kogyo Shinbun, Ltd. (1969)), a melamine resin (e.g., compounds described, for example, in Ichiro Miwa and Hideo Matsunaga ed., *Urea●Melamine Jyushi* (Urea●Melamine Resins), The Nikkan Kogyo Shinbun, Ltd. (1969)), a poly (meth)acrylate-related compound (e.g., those described, for example, in Makoto Oogawara, Takeo Saegusa and Toshinobu Toumura ed., *Oligomer* (Oligomers), Koudansha (1976) and Eizo Oomori, *Kinousei Acryl-kei Jyushi* (Functional Acrylic Resins), Techno System (1985)).

In the invention, an over-coat layer may be provided on the above-described concavo-convex surface. The over-coat layer comprises a film-forming resin, the species of which are same as those set forth as the binder resin used for the formation of the above-described concavo-convex surface. For the purpose of securing adhesion between the over-coat layer and the concavo-convex surface, a hydrophilic over-coat layer is preferably used on a concavo-convex surface containing a hydrophilic binder resin, and a hydrophobic over-coat layer is preferably used on a concavo-convex surface containing a hydrophobic binder resin.

The over-coat layer can be obtained by coating a coating solution containing the film-forming resin described above and a solvent on the concavo-convex surface using a coating method well known in the art, drying the coated solution, and forming a film. As the solvent, those described above can be appropriately used. Suitable coating methods include those using a coater (e.g., air doctor, blade, rod, squeeze or gravure coater), and spray coating (e.g., air-spray or electrostatic spray coating).

The surface of the packing sheet having a concavo-convex structure according to the invention has preferably a centerline average roughness Ra of 20 μm or less, more preferably 12 μm or less, still more preferably less than 2 μm. With such Ra value, the occurrence of stain in the non-image area is prevented. Moreover, the concavo-convex surface of the packing sheet preferably has Ra/Rz (Rz means ten-point average roughness) of less than 0.17, whereby the effect of preventing plate elongation as well as plate slippage is exerted more efficiently.

Separately, a concavo-convex structure can also be formed on the rear surface of the printing plate in a similar manner as in the above-described packing sheet. An over-coat layer can also be provided similarly.

The rear surface of a lithographic printing plate having a concavo-convex structure according to the invention preferably has a centerline average roughness (Ra) of not more than 20 μm, more preferably not more than 12 μm, and particularly preferably less than 1.5 μm. In particular, it is preferred to control the Ra value in a range of less than 1.5 μm, because the occurrence of stain in the non-image area is prevented and the occurrence of scratch on the surface of printing plate is also prevented.

Furthermore, the sum of the Ra values of the concavo-convex structures of the packing sheet and the rear surface of printing plate is preferably from 20 μm to 0.1 μm, more preferably from 12 μm to 0.1 μm, and particularly preferably from 3.5 μm to 0.1 μm.

To fix the packing sheet of the invention onto the plate cylinder, various methods well known in the art can be used. For example, a method of applying an adhesive or tackifier such as a spray paste or double-faced adhesive tape onto the rear surface of packing sheet support, and a method in which the front and rear edges of the packing sheet are fastened with hooks provided on the plate cylinder are exemplified. Combinations of these methods may also be used.

To attach the printing plate 70 on the plate cylinder 11 in such a condition, the operator, first of all, places the printing plate 70 in the guide member 20, then thrusts the printing plate 70 in such a manner that the plate front end 70*a* is inserted into the gap between the upper tooth 12*a* and the lower tooth 12*b* of the plate front end clamping mechanism, and brings the inner peripheral surface of the notch 71 of the plate front end 70*a* into contact with the registration pin 14 shown in FIG. 2 to conduct the positioning of the plate front end 70*a*. Under this condition, the upper tooth 12*a* is closed to fix the plate front end 70*a*.

Then, under the condition shown in FIG. 1, the plate cylinder 11 is rotated anti-clockwise by the control member (not shown) to wind the printing plate 70 around the plate cylinder 11. The rotation of the plate cylinder 11 is continued until the moment when the control member detects the rotational position of the plate cylinder where the pressure roller 17 can get contact with the flat portion 11*a* of the plate cylinder. At the moment, the control member stops the rotation of the plate cylinder 11.

Figure 5:
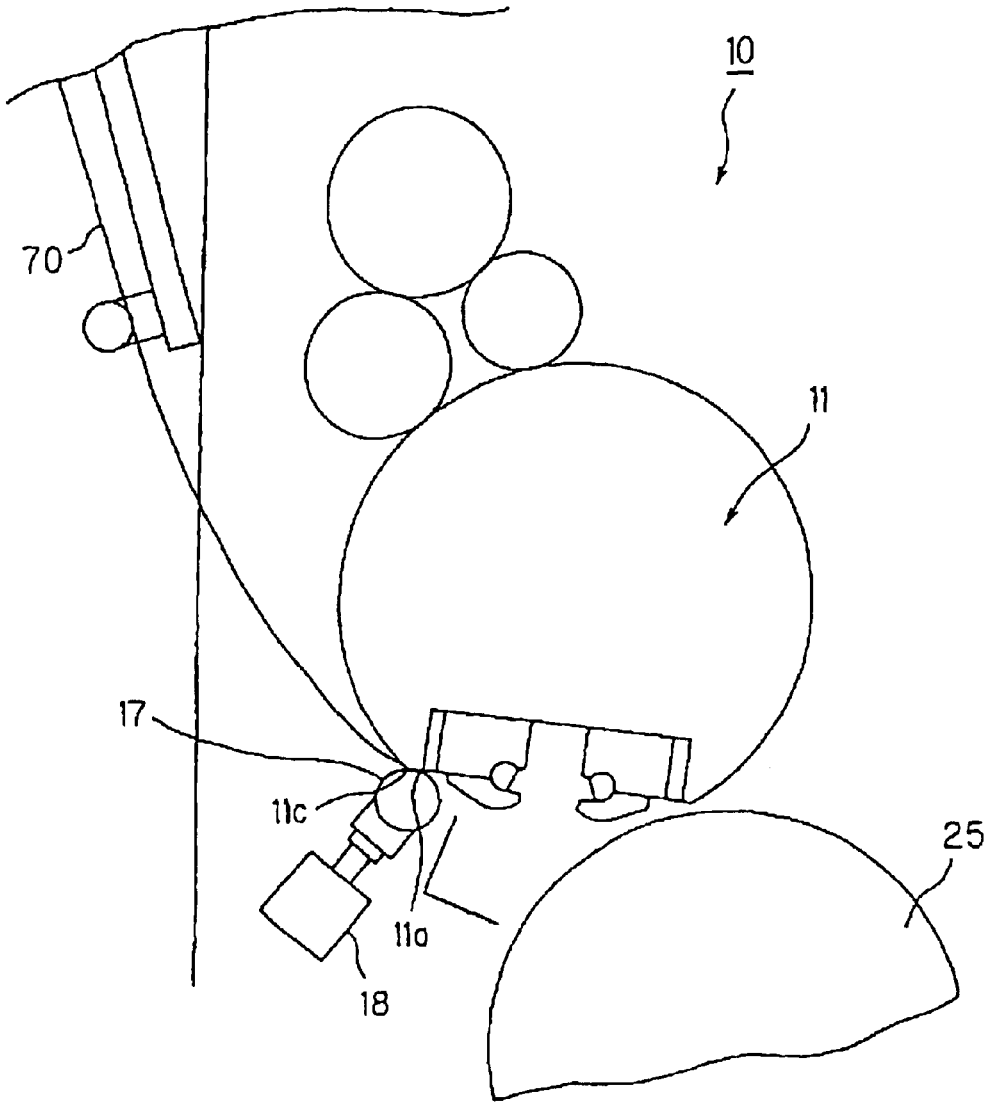
FIG. 5 is a view showing how a printing plate is attached according to the first embodiment of the invention.

Now, as shown in FIG. 5, the pressure roller 17 is brought into contact with the flat portion 11*a* of the plate cylinder to press the printing plate 70 toward the outer peripheral surface of the plate cylinder 11. Then, the plate cylinder 11 is again rotated anti-clockwise by the control member (not shown). By such procedures, the printing plate 70 can be pressed onto the outer peripheral surface of the plate cylinder by means of the pressure roller 17 in the vicinity of the ridge portion 11*c* of the plate cylinder. During the procedures, the pressure roller 17, which is urged toward the outer peripheral surface of the plate cylinder by means of the cylinder 18, moves back and forth according to the contour of the outer peripheral surface of the plate cylinder.

Figure 6:
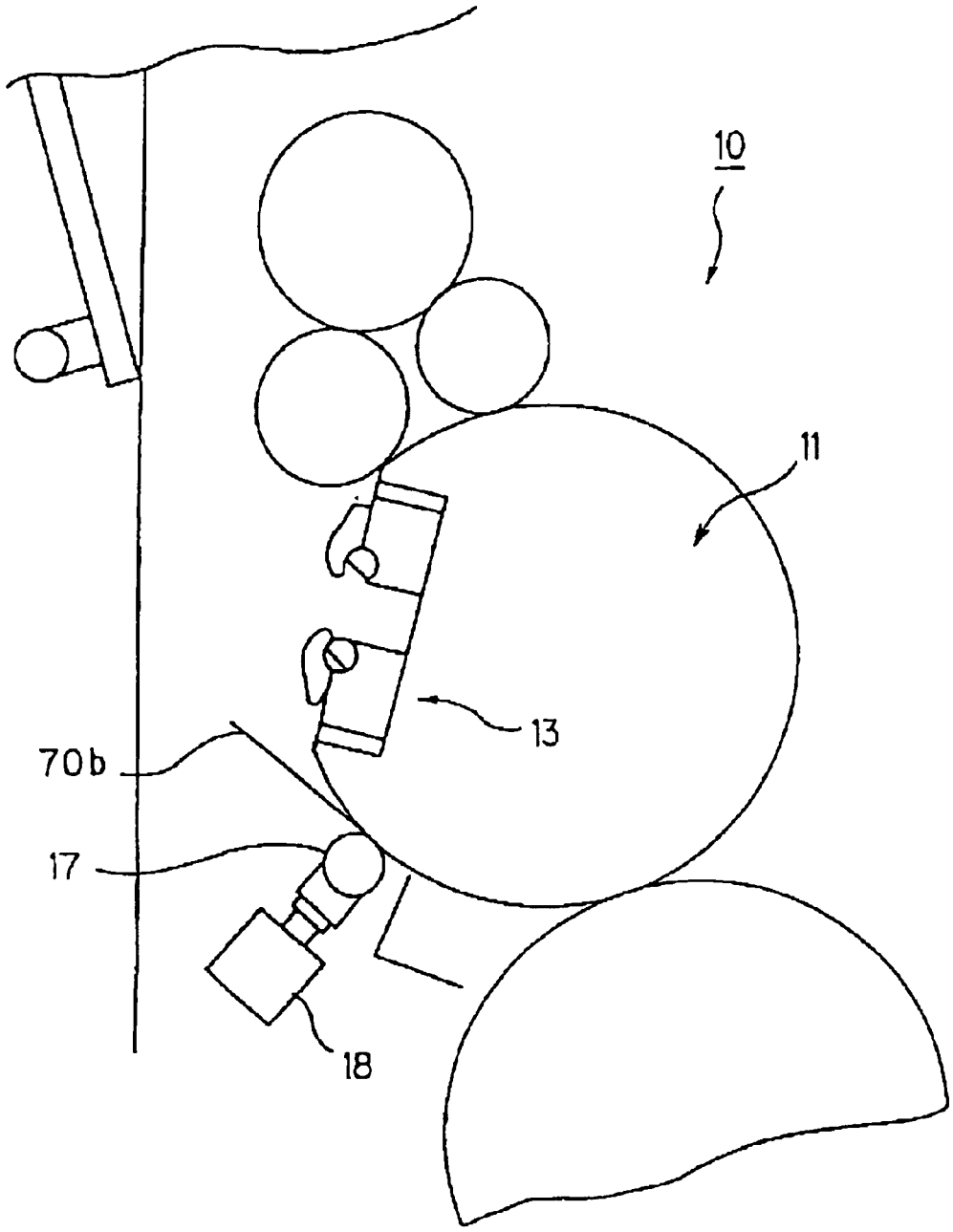
FIG. 6 is a view showing how a printing plate is attached according to the first embodiment of the invention.

Thereafter, the rotation of the plate cylinder 11 is further continued, and when the printing plate has been wound up to the vicinity of the PTE-clamping mechanism 13 as shown in FIG. 6, the control member (not shown) suspends the rotation of the plate cylinder 11.

Figure 7:
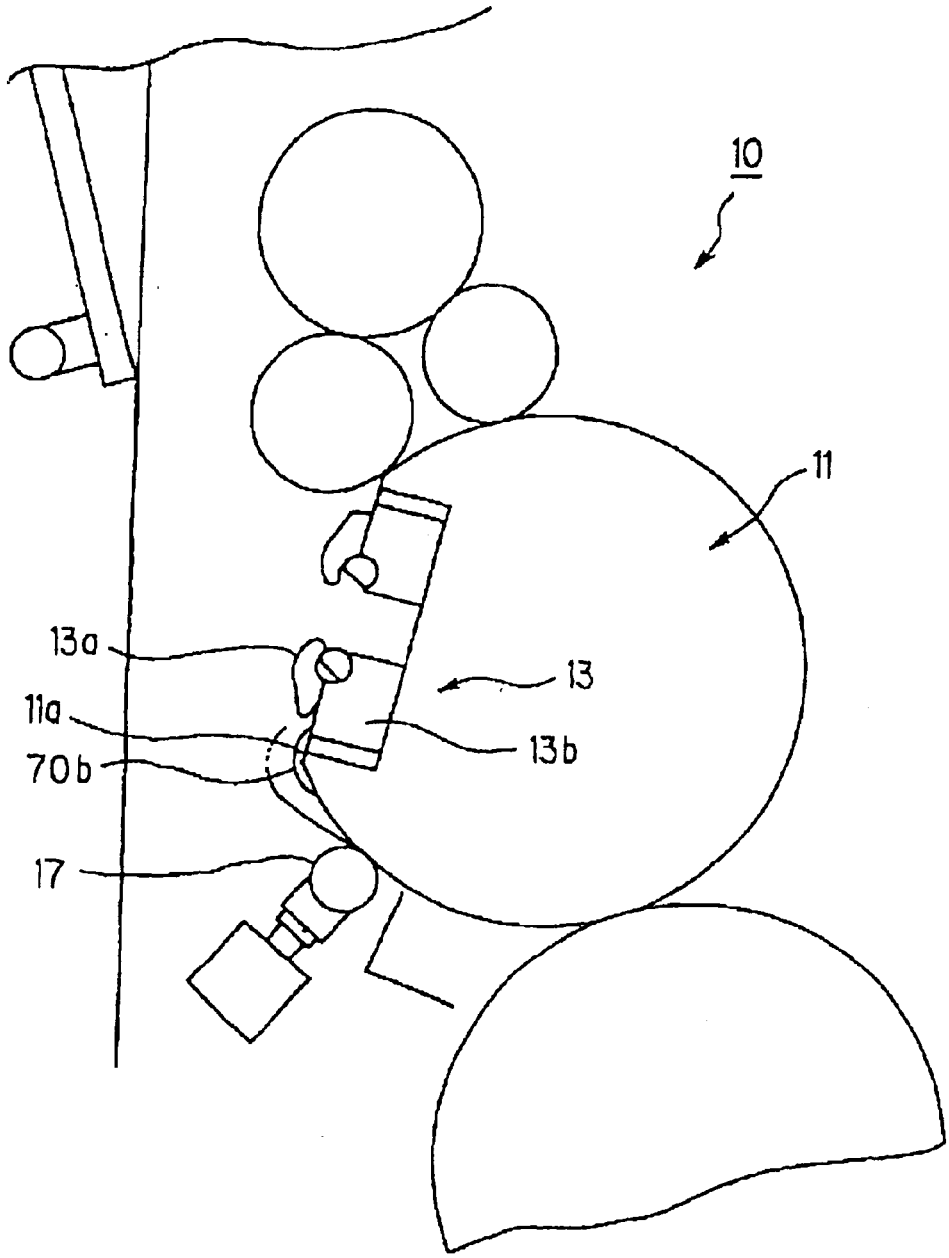
FIG. 7 is a view showing how a printing plate is attached according to the first embodiment of the invention.
Figure 8:
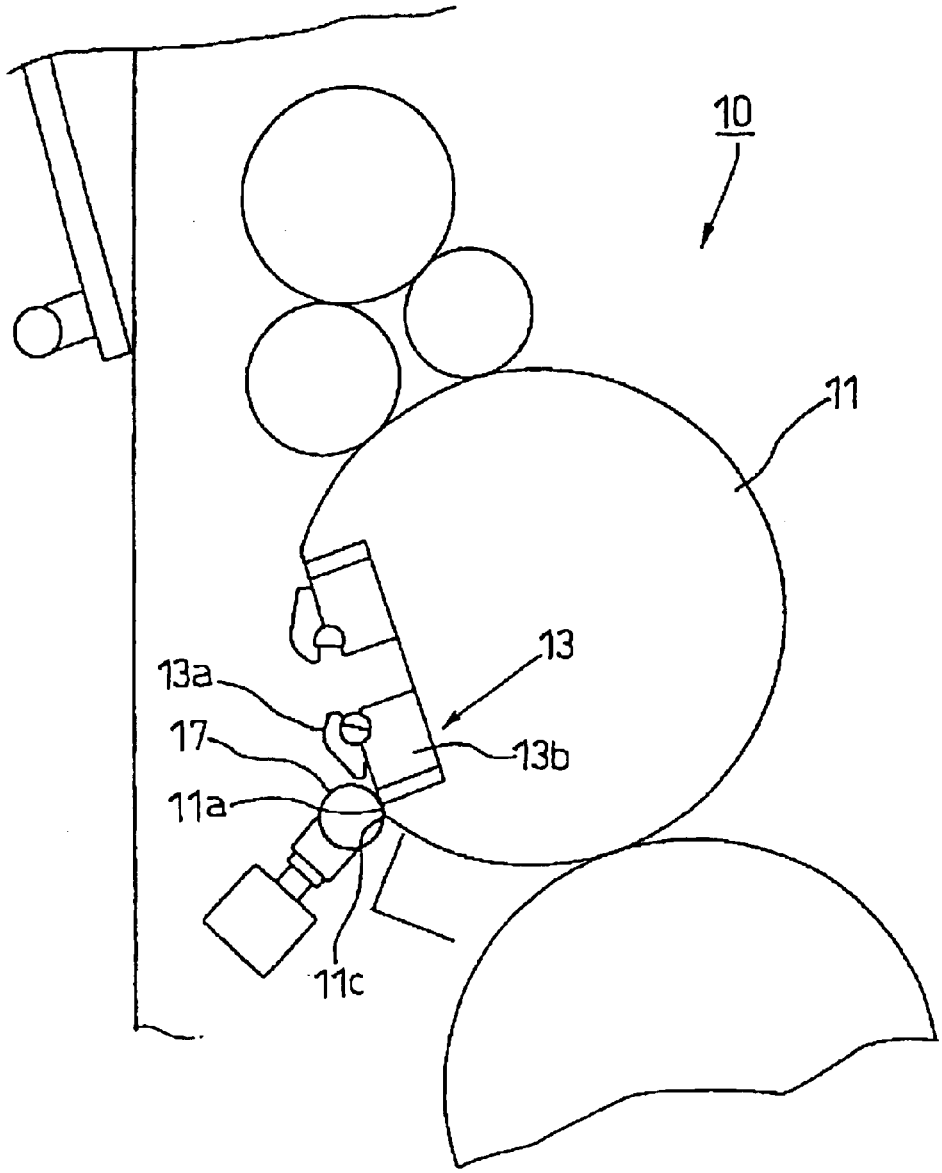
FIG. 8 is a view showing how a printing plate is attached according to the first embodiment of the invention.

Then, the operator bends the printing plate in the vicinity of the plate rear end thereof as shown in FIG. 7, and inserts the plate rear end 70*b* into the space between the upper tooth 13*a* and the lower tooth 13*b* of the plate rear end clamping mechanism. In this stage, the plate rear end 70*b* float up from the flat portion 11*a* of the plate cylinder 11 and the top surface of the lower tooth 13*b*. Again, the plate cylinder 11 is rotated anti-clockwise by the control member (not shown). By such procedures, the printing plate can be pressed toward the outer peripheral surface of the plate cylinder in the vicinity of the ridge portion thereof by the pressure roller 17, and at the same time, the plate rear end can be brought into close contact with the flat portion 11*a* and the upper surface of the lower tooth 13*b*, as shown in FIG. 8.

Finally, after the upper tooth 13*a* of the plate rear end clamping mechanism is closed to fix the plate rear end, the pressure roller 17 is retreated from the printing plate 70 by the control member (not shown), whereby the attaching operation of the flexible printing plate on the plate cylinder 11 is completed.

In the printing plate-attaching unit 10 having the configuration as described above, the positioning is performed by bringing the plate front end 70*a* of the flexible printing plate 70 into contact with the seven registration pins 14 protrusively provided on the lower tooth 12*b* of the plate front end clamping mechanism. Accordingly, the distance between the registration pins on the plate cylinder is narrower than that in a conventional printing plate-attaching apparatus, and even when a printing plate as large as the half Kiku size is used, the deformation of printing plate in such a manner that the plate front end 70*a* protrudes from the spacing between the registration pins 14 is prevented.

Since, in the printing plate-attaching unit 10, the pressure roller 17 presses the printing plate toward the outer peripheral surface of the plate cylinder including the vicinity of the ridge portion (i.e., both of the ridge portion on the plate front end clamping mechanism 12 side and that on the plate rear end clamping mechanism 13 side) 11*c*, the printing plate 70 which wound around the plate cylinder 11 never float up from the outer peripheral surface of the plate cylinder. Accordingly, the operator need not strongly pull the plate rear end 70*b* to avoid the floating of the printing plate 70, and thus the plate rear end 70*b* of the flexible printing plate does not suffer from the deformation including elongation. In addition, the operator's workload in the flexible printing plate-attaching operation is reduced.

When the plate rear end 70*b* is fixed to the plate rear end clamping mechanism 13 in the present embodiment, the operator bends the printing plate in the vicinity of the plate rear end thereof and inserts the plate rear end 70*b* into the space between the upper tooth 13*a* and the lower tooth 13*b* of the plate rear end clamping mechanism. Thus, the plate rear end clamping mechanism 13 need not be so constructed as being capable of opening the upper tooth 13*a* widely, whereby the configuration of the plate rear end clamping mechanism can be simplified.

Moreover, since a cover of the printing press 50 is used as the plate-shaped member 21 of the guide member 20, the cost saving and size reduction of the printing plate-attaching unit can be achieved.

Of the seven registration pins 14, only one pin is made to have the width in the direction of the plate cylinder axis larger than those in the same direction of the remaining pins. Thus, the operator can easily bring the inner peripheral surface of each notch 71 of the printing plate into contact with each registration pin 14. Also, the printing plate 70 can be precisely positioned by means of the single registration pin having the width in the direction of the plate cylinder axis larger than those in the same direction of the remaining pins.

Further, since the plate cylinder 11 is automatically rotated and stopped at a pre-determined position by the control member and the pressure roller 17 is also automatically brought into contact with and separated from the plate cylinder 11 at pre-determined positions by the control member, the workload of the operator is further reduced.

Further, the printing plate having a concavo-convex structure on the rear surface thereof and the packing sheet having a concavo-convex structure at least on one surface thereof are wound around the plate cylinder in such a manner that the concavo-convex surfaces face each other. In such a case, since the concavities and convexities on the surface of the packing sheet are arranged to face the concavities and convexities on the rear surface of the lithographic printing plate, when a printing pressure is applied to both the packing sheet and the lithographic printing plate during printing, the pressure acts the concavities and convexities on the two surfaces to bite into each other.

Hence, the deformation and slippage of printing plate 70 which may take place after the contact of the printing plate with the outer peripheral surface of the plate cylinder can be surely prevented.

In the present embodiment, when the pressure roller 17 is brought into contact with and separated from the plate cylinder 11, the rotation of the plate cylinder 11 is stopped. However, by modifying a setup of the control member (not shown), the pressure roller 17 may be brought into contact with and separated from the plate cylinder 11 without stopping the plate cylinder 11.

Figure 15:
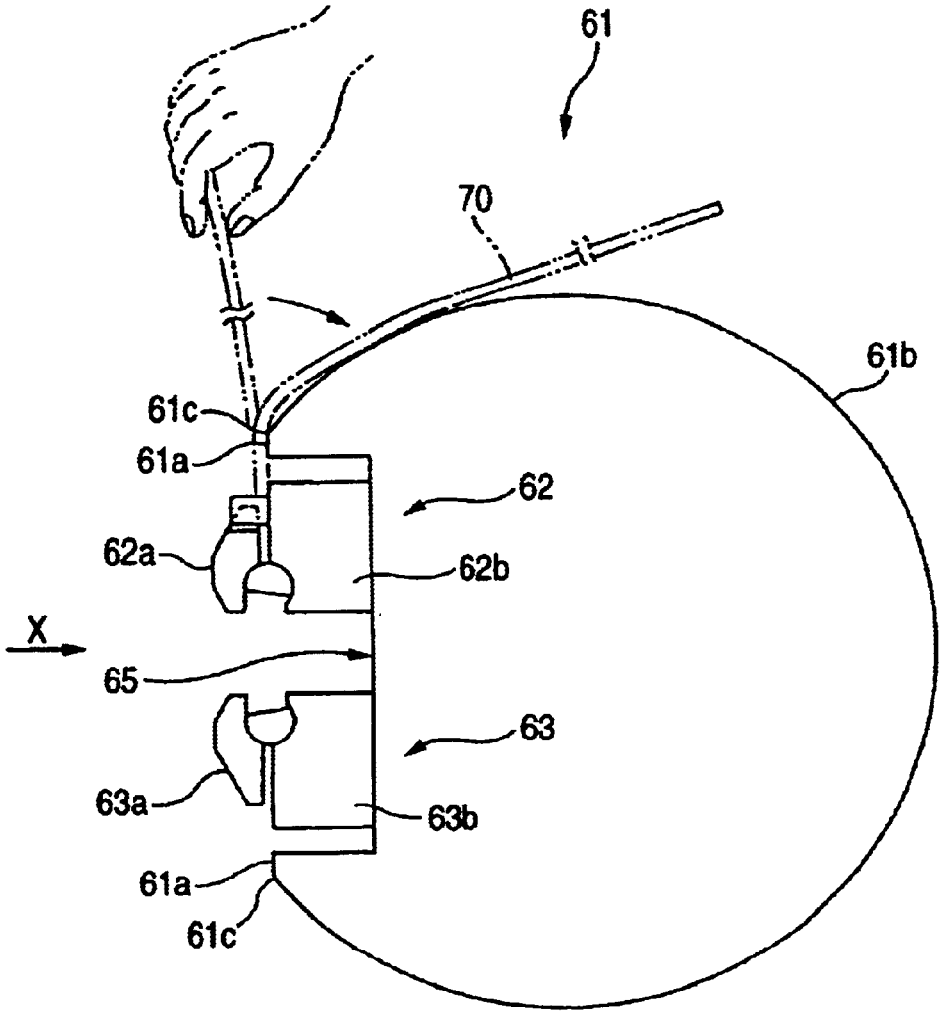
PRIOR ART FIG. 15
FIG. 15 is a view showing a conventional printing plate-attaching unit.
Figure 16:
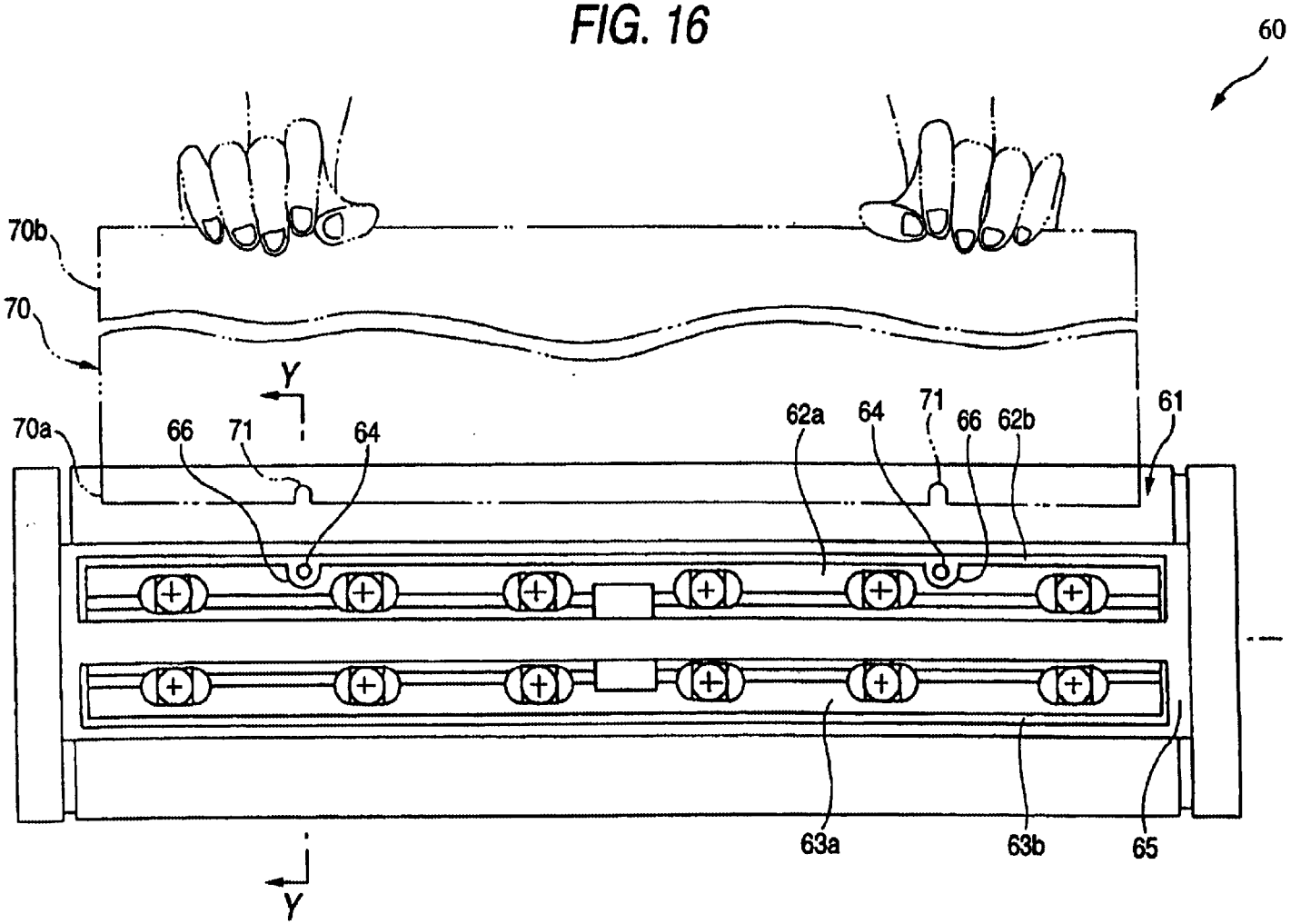
PRIOR ART FIG. 16
FIG. 16 is a view taken from the direction of the arrow X shown in FIG. 15.

Next, the second embodiment of the invention will be described with reference to FIGS. 9 and 10. In the plate-attaching unit of the present embodiment, a conventional plate cylinder 61 shown in FIGS. 15 and 16 is used as a plate cylinder. Around the plate cylinder 61 is wound and fixed the packing sheet 27 (See FIG. 3.) having concavities and convexities in at least one surface thereof, which is used in the first embodiment described above, in such a manner that the concavo-convex surface faces outward.

The present embodiment has a similar structure to the printing plate-attaching unit 10 (See FIG. 1.) according to the first embodiment except for the plate cylinder.

Figure 9:
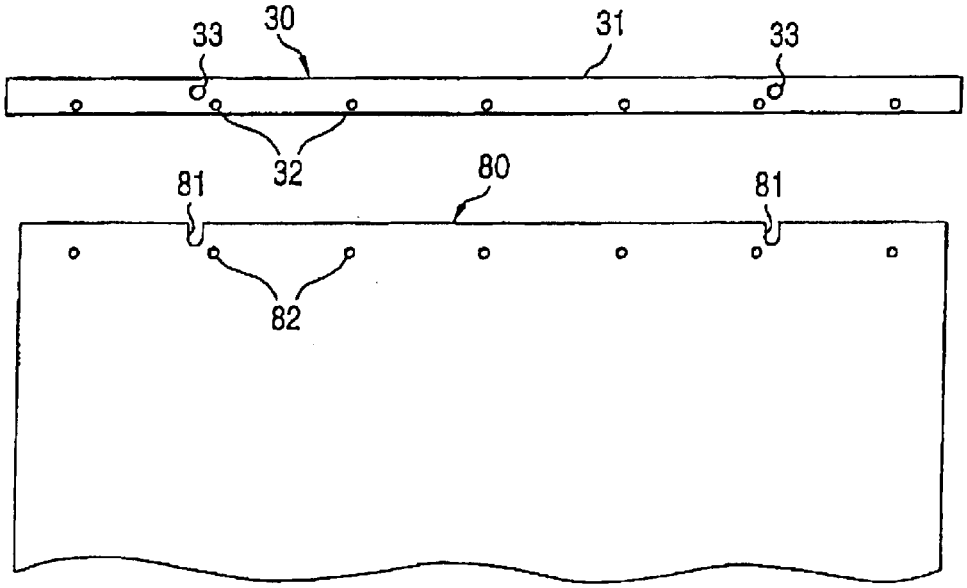
FIG. 9 is a view showing a printing plate and a pin contact member used in the second embodiment of the invention.
Figure 10:
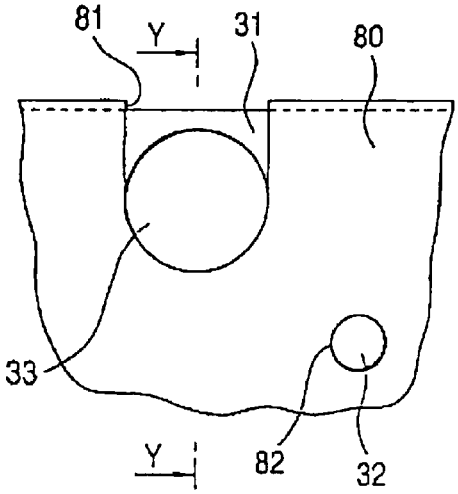
FIG. 10 is a view showing a state in which the pin contact member depicted in FIG. 9 is fixed to the printing plate.
Figure 10:
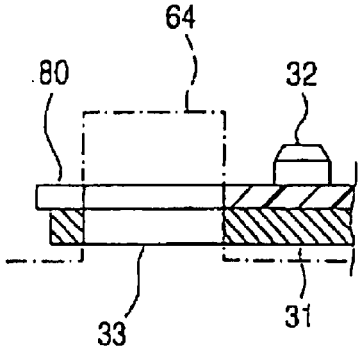

In FIG. 9, there are shown a flexible printing plate 80 and a pin contact member 30 that is fixed at the plate front end of the printing plate 80, both used in the present embodiment. In the plate front end of the printing plate 80, there are formed notches 81 each having a roughly U-shaped peripheral edge in the positions corresponding to those of the two registration pins 64 shown in FIG. 16. Also in the plate front end, there are formed at least three (seven in the figure) fixing holes 82 with an appropriate spacing in the width direction (in FIG. 9, in the right and left direction) of the printing plate 80.

The pin contact member 30 has a strip-shaped base plate 31, which is made of a highly rigid material such as metal and has a length equal to or larger than the width of the printing plate 80. In the base plate 31, there are provided circular-shaped insertion holes 33 in the positions corresponding to the positions of the two registration pins 64 shown in FIG. 16. Further, in the base plate 31, at least three (seven in the figure) fixing pins 32 are protrusively provided with an appropriate spacing in the lengthwise direction of the base plate.

FIG. 10(A) is an enlarged view of the vicinity of each notch 81 of the printing plate 80 in the state where the pin contact member 30 shown in FIG. 9 is fixed to the plate front end of the printing plate 80. FIG. 10(B) is a cross-sectional view taken along the line Y—Y shown in FIG. 10(A). As shown in FIG. 10(A), the pin contact member 30 is fixed to the printing plate 80 by inserting the fixing pins 32 of the pin contact member 30 into the fixing holes 82 of the printing plate 80. A part of the peripheral edge of the circular-shaped insertion hole 33 of the pin contact member is so shaped as to fit the curved portion of the roughly U-shaped peripheral edge of the notch 81 of the printing plate 80.

In attaching the printing plate 80 on the plate cylinder 61 shown in FIG. 16, the plate front end of the printing plate 80 may be firstly fixed to the pin contact member 30 and then, the plate front end may be fixed to the plate front end clamping mechanism 62, or alternatively, under the condition that the registration pins 64 of the plate front end clamping mechanism 62 are inserted into the insertion holes 33 of the pin contact member 30, the plate front end of the printing plate 80 may be fixed to the pin contact member 30.

As shown by a one-dot chained line in FIG. 10(B), when the registration pins 64 of the plate cylinder are inserted into the insertion holes 33 of the pin contact member, the inner peripheral surfaces of notches 81 of the printing plate are respectively contacted with the registration pins 64 together with the inner peripheral surface of the insertion holes 33 of the pin contact member.

The operation of attaching the printing plate 80 by winding around the plate cylinder 61 is carried out in a similar manner to the first embodiment.

In the printing plate-attaching unit having the configuration as described above, the plate front end of the flexible printing plate 80 is protected by the highly rigid pin contact member 30 in case of the positioning and fixation of the plate front end by means of the plate front end clamping mechanism, whereby the deformation of the plate front end can be prevented. By the use of pin contact member 30, the deformation of the printing plate can be prevented without increasing the number of registration pins, and thus it is possible to use a plate cylinder 61 of the existing printing press. When the present embodiment is performed using the existing facility, the facility cost can be markedly reduced.

Now, with reference to FIGS. 11 and 12, the third embodiment of the invention is described below. The present embodiment is similar to the second embodiment described above except for modifying the pin contact member 30 of the second embodiment.

Figure 11:
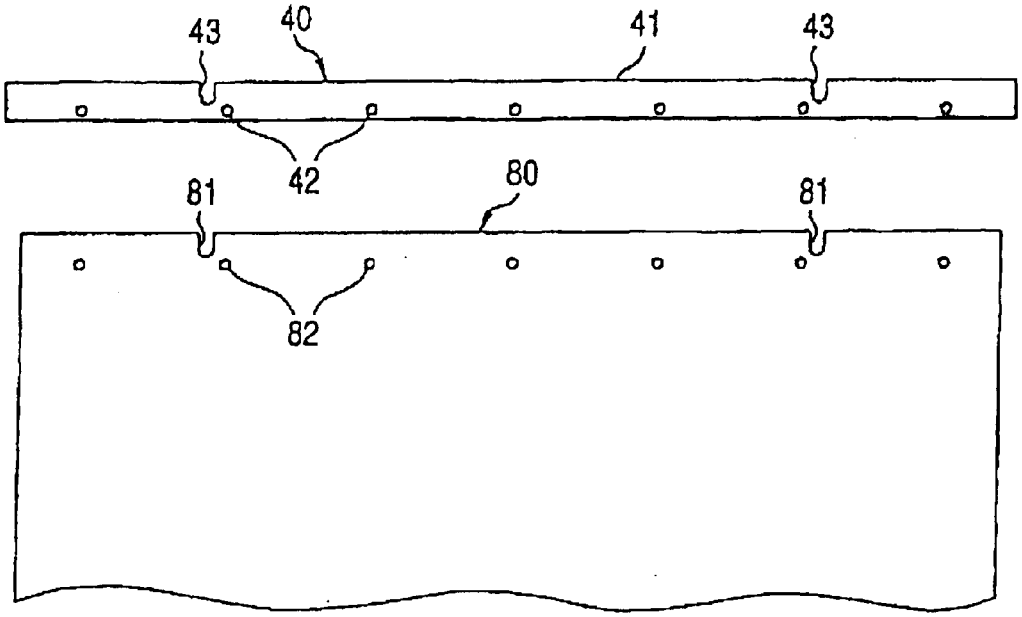
FIG. 11 is a view showing a printing plate and a pin contact member used in the third embodiment of the invention.

In FIG. 11 are shown a flexible printing plate 80 and a pin contact member 40 to be fixed to the plate front end of the printing plate 80, both used in the present embodiment.

The pin contact member 40 has a base plate 41, which is made of a highly rigid material such as metal and has a length equal to or longer than the width of the printing plate 80. In the base plate 41, there are provided notches 43 each of which has a roughly U-shaped peripheral edge in the positions corresponding to the positions of the two registration pins 64 of the plate cylinder 61 shown in FIG. 16. Further, in the base plate 41, at least three (seven in the figure) fixing pins 42 are protrusively provided with an appropriate spacing in the lengthwise direction of the base plate.

Figure 12:
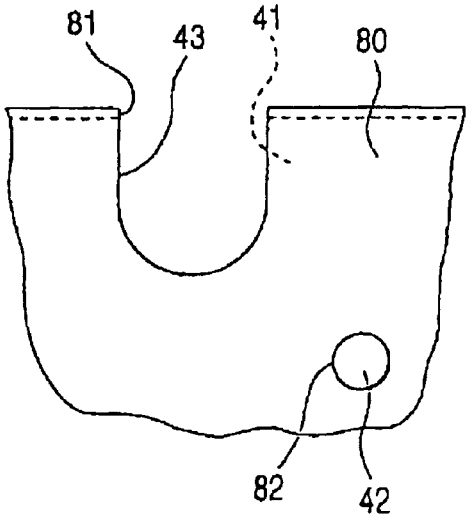
FIG. 12 is a view showing a state in which the pin contact member depicted in FIG. 11 is fixed to the printing plate.

FIG. 12 is an enlarged view of the vicinity of each notch 81 of the printing plate 80 in the state where the pin contact member 40 is fixed to the plate front end of the printing plate 80. As shown in FIG. 12, the pin contact member 40 is fixed to the printing plate 80 by inserting the fixing pins 42 of the contact member 40 into the fixing holes 82 of the printing plate 80. The peripheral edge of the notch 43 of the pin contact member 40 is so shaped as to fit the peripheral edge of the notch 81 of the printing plate 80.

In the printing plate-attaching unit having the configuration as described above, for the fixation of the plate front end to the plate front end clamping mechanism after fixing the pin contact member 40 to the plate front end of the printing plate 80, the pin contact member 40 is inserted between the upper tooth and the lower tooth of the plate front end clamping mechanism to conduct the positioning of both the pin contact member 40 and the plate front edge of the printing plate 80. Therefore, the operation for the positioning and fixation of the plate front end are further simplified.

Figure 13:
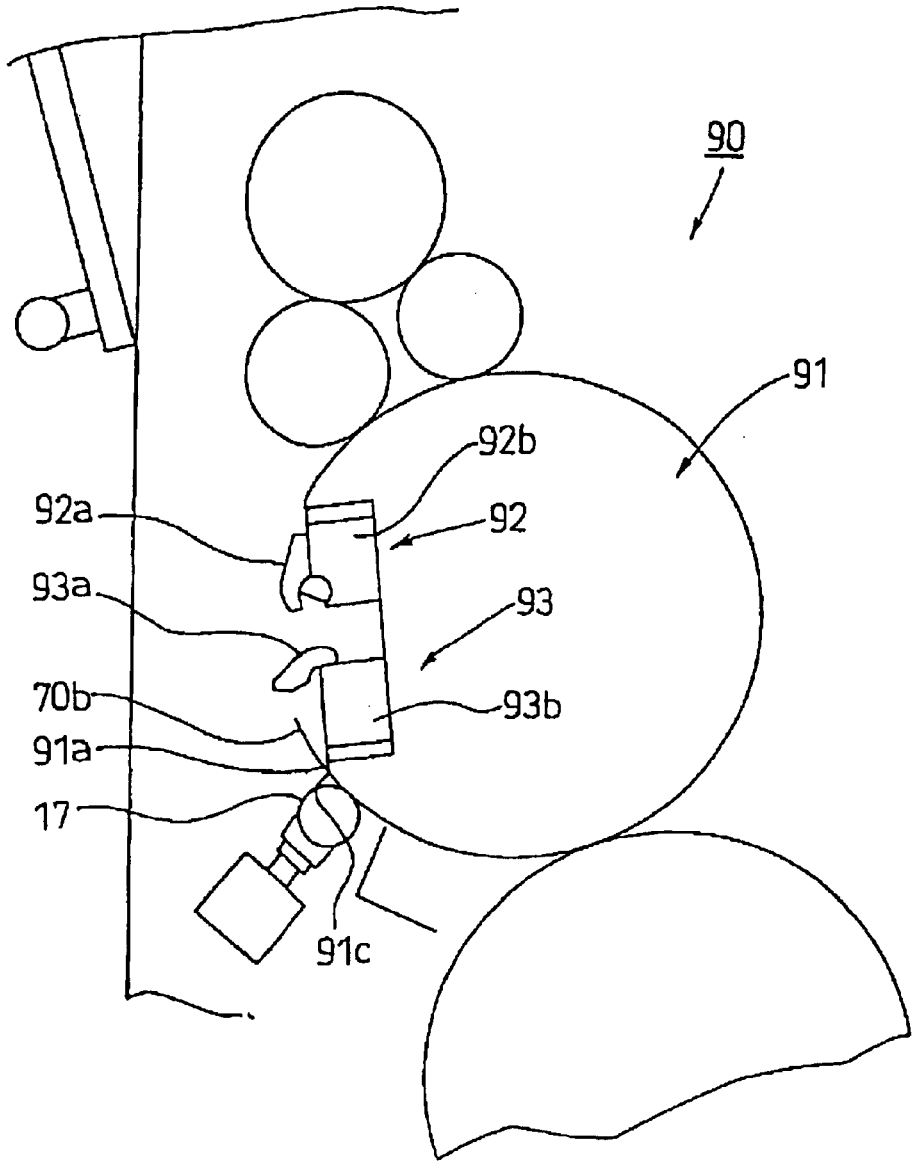
FIG. 13 is a view showing the fourth embodiment of the invention.

FIG. 13 is a view showing the fourth embodiment of the invention. In the plate-attaching unit 90 of the present embodiment, an upper tooth 93*a* of a plate rear end clamping mechanism 93 provided in a plate cylinder 91 is so constructed that the upper tooth 93*a* can be widely drawn apart from the upper surface of a lower tooth 93*b*. In other words, the upper tooth 93*a* can take such a position as not to cover the upper surface of the lower tooth 93*b*. In the embodiment, the upper tooth 93*a* can be pivoted until the angle between the lower surface of the upper tooth 93*a* and the upper surface of the lower tooth 93*b* becomes equal to or larger than an angle where the plate rear end and the clamp plane of the upper tooth 93*a* are not contacted with each other in the situation shown in FIG. 13.

In the printing plate-attaching operation, the plate front end is fixed by the plate front end clamping mechanism 92 and the printing plate is wound around the outer peripheral surface of the plate cylinder 91 in a similar manner to the first embodiment. Then, as shown in FIG. 13, when the printing plate is wound around the plate cylinder up to the vicinity of the plate rear end clamping mechanism 93, the upper tooth 93*a* of the plate rear end clamping mechanism 93 is opened widely in such a manner that the upper tooth 93*a* does not cover the upper surface of the lower tooth 93*b*.

Then, as is shown in FIG. 13, the plate cylinder 91 is rotated anti-clockwise while the pressure roller 17 is kept in contact with the curved portion of the plate cylinder 91 to press the printing plate toward the outer peripheral surface of the plate cylinder. Thus, the pressure roller 17 can press the printing plate toward the outer peripheral surface of the plate cylinder in the vicinity of the ridge portion 91*c* of the plate cylinder, and at the same time, the plate rear end 70*b* can be brought into close contact with the flat portion 91*a* of the printing plate and the upper surface of the lower tooth 93*b*.

Finally, after the plate rear end 70*b* of the printing plate is fixed by closing the upper tooth 93*a* of the plate rear end clamping mechanism, the pressure roller 17 is retreated from the printing plate to complete the attaching operation of the flexible printing plate on the plate cylinder 91.

In the printing plate-attaching unit 90 having the configuration described above, the operator need not bend the plate rear end 70*b* of the printing plate for the insertion of the plate rear end between the upper tooth 93*a* and the lower tooth 93*b* of the plate rear end clamping mechanism 93. Therefore, the printing plate-attaching operation is further simplified and suited for automation.

Figure 14:
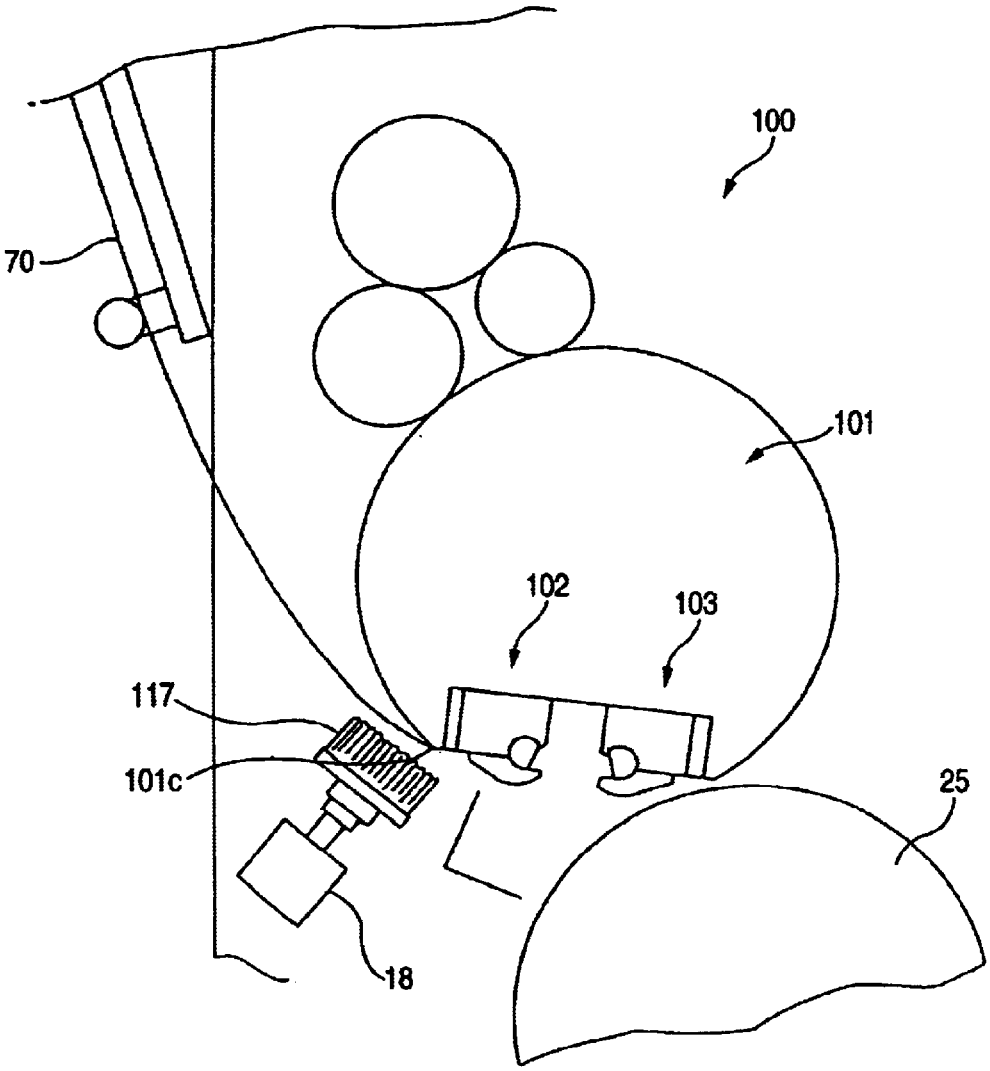
FIG. 14 is a view showing the fifth embodiment of the invention.

FIG. 14 is a view showing the fifth embodiment of the invention. In the plate-attaching unit 100 of the present embodiment, a planar pressure member is used as a pressure member that presses the printing plate 70 toward the outer peripheral surface of the plate cylinder 101 at least in the vicinities of the ridge portions of the plate cylinder. The planar pressure member in the embodiment comprises a brush 117 in which the tips are approximately aligned so as to form a single flat plane and which is driven by an air cylinder 18 to be brought into contact with and separated from the plate cylinder 101.

As the brush, a brush comprising a chemical synthetic fiber such as nylon, polypropylene, poly(vinyl chloride), PBT or Aramide, a plant fiber (palm), or an animal fiber (e.g., hog bristle, horsehair or goat hair) can be employed.

The operation of winding and attaching the printing plate 70 onto the plate cylinder 101 is carried out in a similar manner to the first embodiment. However, since the printing plate 70 is pressed toward the outer peripheral surface of the plate cylinder 101 over a broad area by means of the planar pressure member in the present embodiment, the accuracy of timing for stopping the rotation of plate cylinder 101 in the procedure for winding of the printing plate 70 may be low.

In the printing plate-attaching unit 100 having the configuration described above, the floating of the printing plate from the outer peripheral surface of the plate cylinder 101 can be reliably and easily prevented, since the printing plate 70 can be presses toward the outer peripheral surface of the plate cylinder 101 over a broad area by the planar pressure member. For example, the operator can attach a printing plate by manually rotating and stopping the plate cylinder.

In the present embodiment, the brush is so shaped that its tip forms a single flat plane. However, the tip of the brush may be arranged so as to form a plurality of planes as long as the brush can certainly press the printing plate toward the outer peripheral surface of the plate cylinder. For example, the brush may be arranged so that the cross-sectional view of the tip plane thereof is V-shaped.

In the present embodiment, a brush is used as the planar pressure member. However, a pad made of sponge (e.g., urethane sponge or cellulose sponge) or felt may also be used in place of the brush. A pad comprising a core material made of, e.g., sponge, felt or rubber covered with moulton (cloth) may be also used.

The invention should not be construed as being limited to the above-described embodiments, but modifications and improvements can be appropriately made.

The invention is described in more detail with reference to the following examples, but the invention should not be construed as being limited thereto.

EXAMPLE 1

To verify the superiority of the invention, actual printing operations were carried out for evaluation. Specific conditions and results are described in detail below.

Preparation of Packing Sheet

Into 50 g water, 5 g of polyvinyl alcohol (PVA 405 made by Kuraray Co., Ltd.) was added with stirring followed by stirring for 30 minutes.

To the solution, 3 g of tetramethoxysilane (made by Shin-Etsu Chemical Co., Ltd.) was added followed by stirring for 30 minutes. To the solution was added 1 ml of concentrated hydrochloric acid followed by stirring for 2 hours, and then glass beads (GB731 made by Toshiba Glass Co., Ltd.; an average diameter: 30 $\mu$m) were added. The resulting mixture containing the glass beads was charged in a paint shaker (made by Toyo Seiki Co., Ltd.) and dispersed for 10 minutes. Thereafter, the glass beads were removed by filtration to obtain a dispersion. The dispersion was coated on a surface of a support made of a 100 $\mu$m thick polyethylene terephthalate (PET) film by a wire bar so as to give a coating amount of 5 g/m$^2$. The coated layer was dried at 110° C. for 3 min to obtain a packing sheet for lithographic printing. The centerline average roughness Ra of the roughened surface thereof was 1.8 $\mu$m and Ra/Rz thereof was 0.10.

Preparation of Printing Plate Precursor

On a rear surface of a silver salt diffusion transfer type printing plate precursor (SDP-FHN 175 made by Mitsubishi Paper Mills Co., Ltd.) having a total thickness of 200 $\mu$m, comprising a substrate of 100 $\mu$m thick polyethylene terephthalate (PET) was coated the coating dispersion same as used in the preparation of packing sheet for lithographic printing by a wire bar so as to give a coating weight of 5 g/m$^2$. The coated layer was dried under an ambient atmosphere to obtain a lithographic printing plate precursor having a roughened rear surface. The Ra value of the roughened surface thereof was 1.2 $\mu$m.

For evaluation of printing, a 2-color, offset sheet-fed rotary printing press DAIYA-1F2 (made by Mitsubishi Heavy Industries, Ltd.) was used.

Evaluation Tires

As indices for the verification of superiority of the invention, the following four items were evaluated: position accuracy of the plate front end at the time of plate attachment, the maximum plate elongation at the time of plate attachment, plate slippage caused by printing and stain in the non-image area.

For the evaluation, an aluminum-supported printing plate which exhibits good plate-attaching position accuracy and no plate alignment during printing was attached on a first-color plate cylinder, a flexible printing plate was attached on a second-color plate cylinder in a manner described below, respectively, and two-color printing was conducted. The printed position of the first color was used as a standard and slippage of the printed position of the second color from that of the first color was measured. The evaluation of printing is described in more detail below.

Preparation of Printing Plate

The above-described printing plate precursor having concavities and convexities on the rear surface thereof was used as a flexible printing plate precursor. As an aluminum-supported printing plate precursor, LP-NS2 (made by Fuji Photo Film Co., Ltd.) having a thickness of 300 $\mu$m was used.

For image exposure, an XLP4000 plate setter (made by Optronics, Inc.) was used. The two printing plate precursors were exposed to the same image for evaluation under the respective standard exposure conditions. Register marks were made, as measuring points, at the positions of each plate corresponding to the leading edge and the rearmost edge of the maximum printing length of the printing press.

After image exposure, each printing plate precursor was subjected to development processing according to the standard system thereof to obtain a printing plate for evaluation.

Accordingly, the dimensions of the images formed on the flexible printing plate and the aluminum-supported printing plate thus obtained are substantially the same.

Printing Plate Attachment

The aluminum-supported printing plate was attached on the first-color plate cylinder of the printing press. In order to avoid slight elongation at the plate attachment and slight plate slippage during printing, the printing plate as the standard was attached in the following manner. Firstly, a 100 $\mu$m thick polyethylene terephthalate film sprayed with Spray Paste 55 (mage by 3M Co.) on one surface thereof was attached by winding and fixed onto the plate cylinder as a packing sheet in such a manner that the paste-sprayed side thereof faced the plate cylinder. Next, the aluminum-supported printing plate sprayed with Spray Paste 55 (mage by 3M Co.) on the rear surface thereof was attached by a conventional manner. In the plate attachment, the tension applied after the plate rear end fixation was adjusted to the minimum that is just enough to eliminate the slack in the vicinity of the plate rear end. In the case where still slack remained at the plate rear end clamp, such slack was removed using a fine adjusting function of the plate rear end clamping mechanism.

The packing sheet prepared above was attached on the second-color plate cylinder of the printing press. Specifically, the packing sheet was sprayed with Spray Paste 55 (mage by 3M Co.) on the rear surface and attached onto the plate cylinder in such a manner that the paste-sprayed side faced the plate cylinder. Then, the flexible printing plate was attached according to the method described in the first embodiment.

Evaluation of Position Accuracy of Plate Front End and Maximum Plate Elongation at the Time of Plate Attachment Prior to printing, the first-color plate cylinder and the second-color plate cylinder were adjusted to be slightly out-of-phase in the rotational direction by means of a vertical (rotational direction) position-adjusting mechanism of the printing press. As a result, the two register marks of the first and second colors are not superposed and the subsequent measurements can be easily performed.

Then, a first run of printing was conducted, and the resulting first print at the start of the run was sampled.

Next, only the printing plate for the second-color was replaced and a second run was conducted. As in the first printing, the first print at the start of the run was sampled. The type of the replaced printing plate and the image formed thereon are the same as those used in the first printing. A third and further runs were repeated in the same manner as the second printing. Ten runs in total including the first printing were conducted and ten prints were sampled in the example.

For all the ten prints thus sampled, the slippage between the register marks of the first and second colors in the vertical direction was measured at each measuring point located in the front and rear edges on the print.

The position accuracy of plate front end at the time of plate attachment was defined by the difference between the maximum and minimum values among the ten edge slippages thus measured.

The difference between the measured rear edge slippage and the measured front edge slippage was calculated in each sample. The maximum value among the differences in the ten print samples was regarded as the maximum plate elongation at the time of plate attachment.

The reason why the first print in each run was used for the calculations of the position accuracy of plate front end at the time of plate attachment and the maximum plate elongation at the time of plate attachment is that the influence of the plate slippage during printing can be substantially negligible for the first print, and thus the obtained first print can be regarded as accurately representing the attached position of the printing plate.

Evaluation of Plate Slippage During Printing

All the procedures prior to the printing were conducted in the same manner as in the above-described evaluation of position accuracy of plate front end at the time of plate attachment and the maximum plate elongation at the time of plate attachment. After printing 10,000 sheets, the first print and the ten thousandth print were sampled. Then, on each of the sampled first and ten thousandth prints, the slippage between the register marks of the first and second colors in the vertical direction was measured at the measuring point located in the rear edge of the print.

The difference between the measured slippage of the ten thousandth print and the first print in the vertical direction is defined as the plate slippage during printing.

Evaluation of Stain in Non-Image Area

The degree of stain in the non-image area of the print was visually evaluated.

The occurrence of stain in the non-image area can be construed as follows. Coarse particles, if they are present on the surface of the packing sheet, act to deform the soft support of printing plate such as PET under the condition that the packing sheet is superimposed with the printing plate and subjected to printing, and as a result, the printing plate surface is pushed up at the position to cause spot stain. Thus, such a spot is recognized as stain in the non-image area.

As comparative examples to prove the superiority of the invention, the following plate-attaching methods were carried out.

Comparative Example 1

The printing plate attachment procedure was conducted in the same manner as in Example 1 except for using a 200 μm thick SDP-FHN 175 (made by Mitsubishi Paper Mills Co., Ltd.), which did not have concavo-convex structure on the rear surface thereof, as the flexible printing plate.

Comparative Example 2

The printing plate attachment procedure was conducted in the same manner as in Example 1 except for using a 100 μm thick polyethylene terephthalate (PET) film, which did not have the roughened surface, as the packing sheet.

Comparative Example 3

The printing plate attachment procedure was conducted in the same manner as in Example 1 except that a 200 μm thick SDP-FHN 175 (made by Mitsubishi Paper Mills Co., Ltd.), which did not have concavo-convex structure on the rear surface thereof, was used as the flexible printing plate, and any packing sheet was not used.

Comparative Example 4

The printing plate attachment procedure was conducted in the same manner as in Example 1 except that a 200 μm thick PET film having a smooth surface, which was an ordinary packing material was used as the packing sheet, and a200 μm thick SDP-FHN 175 (made by Mitsubishi Paper Mills Co., Ltd.) having no concavo-convex structure on the rear surface thereof was used as the flexible printing plate.

The evaluation results of Example 1 and Comparative Examples 1 to 4 are shown in Table 1.

TABLE 1

| | Position accuracy of plate front end at the time of plate attachment | Maximum plate elongation at the time of plate attachment | Plate slippage during printing | Stain in the non-image area |
|---|---|---|---|---|
| Example 1 | ○ | ○ | ○ | ○ |
| Comparative Example 1 | ○ | ○ | Δ | ○ |
| Comparative Example 2 | ○ | ○ | X | ○ |
| Comparative Example 3 | X | X | X | ○ |
| Comparative Example 4 | ○ | ○ | X | ○ |

Notations for the evaluation of position accuracy of plate front end at the time of plate attachment:

| Notation | Position accuracy of plate front end |
|---|---|
| ○ | 50 μm or less |
| X | larger than 50 μm |

Notations for the evaluation of the maximum plate elongation at the time of plate attachment:

| Notation | Plate elongation length |
|---|---|
| ○ | 100 μm or less |
| X | larger than 100 μm |

Notations for the evaluation of plate slippage during printing

| Notation | Plate slippage length |
|---|---|
| ○ | 50 μm or less |
| Δ | larger than 50 to 100 μm |
| X | larger than 100 μm |

Notations for the evaluation of stain in the non-image area:

| Notation | Stain in the non-image area |
|---|---|
| ○ | None |
| Δ | Little |
| X | Much |

By attaching the printing plate according to the method described in Example 1, satisfactory results on the positional accuracy at the time of plate attachment was obtained since the position accuracy of plate rear end at the time of plate attachment was 50 μm or less and the maximum plate elongation at the time of plate attachment was less than 100 μm. Moreover, it was confirmed that the plate slippage during printing and the stain in the non-image area were effectively prevented.

However, when only the packing sheet for lithographic printing was used as in Comparative Example 1, the roughened surface of the packing sheet was not engaged with the rear surface of the lithographic printing plate, and the fixation of the lithographic printing plate became difficult to occur the plate slippage.

Also, the lithographic printing plate was not engaged with the plate cylinder to occur the plate slippage by only roughening the rear surface of the printing plate as shown in Comparative Example 2.

Further, when the printing plate was attached by a conventional technique as in Comparative Example 3, the position accuracy of plate front end at the time of plate attachment far exceeded 50 μm, and the maximum plate elongation at the time of plate attachment also exceeded 100 μm. Hence, the desirable level of positional accuracy at the time of plate attachment was not achieved. Moreover, the plate slippage during printing occurred.

With the attaching method according to the first embodiment wherein neither the packing sheet nor the rear surface of the printing plate have concavities and convexities as in Comparative Example 4, the good positional accuracy at the time of plate attachment was achieved, but the plate slippage occurred during printing.

EXAMPLES 2 TO 17

Using the same method as in Example 1 except for changing the species and/or the amount added of the particles as shown in Table 2, coating dispersions for the formation of roughened surface were prepared. Using the resulting dispersions packing sheets and lithographic printing plates each having the surface roughness value as shown in Table 2 were prepared and evaluated in the same manner as in Example 1. The results obtained are shown in Table 3.

TABLE 2

| No. | Particles | Amount added (g) | Ra (μm) | Ra/Rz | Packing sheet | Lithographic printing plate |
|---|---|---|---|---|---|---|
| a | GB731 (30 μm) | 2 | 1.9 | 0.12 | a-s | a-p |
| b | " | 4 | 4.5 | 0.35 | b-s | b-p |
| c | " | 6 | 8.4 | 0.5 | c-s | c-p |
| d | Polystyrene (10 μm) | 4 | 1.1 | 0.1 | d-s | d-p |
| e | " | 6 | 1.4 | 0.15 | e-s | e-p |
| f | " | 10 | 4.2 | 0.21 | f-s | f-p |

TABLE 3

| No. | Packing sheet/printing plate | Plate elongation | Plate slippage | Stain in the non-image area |
|---|---|---|---|---|
| Example 2 | a-s/d-p | ○ | ○ | ○ |
| Example 3 | a-s/e-p | ○ | ○ | ○ |
| Example 4 | d-s/d-p | ○ | ○ | ○ |
| Example 5 | d-s/e-p | ○ | ○ | ○ |
| Example 6 | e-s/e-p | ○ | ○ | ○ |
| Example 7 | e-s/d-p | ○ | ○ | ○ |
| Example 8 | b-s/d-p | ○ | ○ | ○–Δ |
| Example 9 | b-s/e-p | ○ | ○ | ○–Δ |
| Example 10 | a-s/f-p | ○ | ○ | ○–Δ |
| Example 11 | a-s/c-p | ○ | ○ | Δ |
| Example 12 | c-s/a-p | ○ | ○ | Δ |
| Example 13 | c-s/d-p | ○ | ○ | Δ |
| Example 14 | c-s/e-p | ○ | ○ | Δ |
| Example 15 | c-s/b-p | ○ | ○ | X |
| Example 16 | c-s/f-p | ○ | ○ | X |
| Example 17 | c-s/c-p | ○ | ○ | X |

In Examples 2 to 17 wherein both the packing sheet and the rear surface of the lithographic printing plate were provided with the concavo-convex structure, it is apparent that the desirable results as for the plate slippage during printing can be obtained compared to the cases (Comparative Examples 1 and 2 described above) where only one of the packing sheet and the rear surface of the lithographic printing plate is provided with the concavo-convex structure.

It is also apparent that the occurrence of stain in the non-image area can be prevented by controlling the sum of the surface roughness of the packing sheet and the surface roughness of the rear surface of printing plate to an appropriate value.

From the results described above, it is seen that the method of attaching a flexible printing plate on a plate cylinder according to the invention, which comprises providing a flexible printing plate having a concavo-convex structure in the rear surface thereof and three or more notches at the plate front edge thereof; providing an apparatus of attaching a flexible printing plate comprising: a plate front end positioning mechanism comprising: a plate front end clamping mechanism having upper teeth and lower teeth for fixing the plate front end of said printing plate to said plate cylinder; and at least three registration pins respectively provided in said plate front end clamping mechanism in such a manner in that they are respectively opposed to said notches of said printing plate; a printing plate pressing mechanism for pressing said printing plate toward said plate cylinder; a plate rear end fixing mechanism for fixing the plate rear end of said printing plate to said plate cylinder; and a packing sheet having a concavo-convex structure at least on one surface thereof and being wound and fixed around said plate cylinder in such a manner that the surface having the concavo-convex structure is faced to said printing plate; positioning and fixing said plate front end to said plate cylinder by inserting said plate front end of said printing plate between said upper and lower teeth of said plate front end clamping mechanism to contact an inner peripheral surface of said notches of said plate front end with said at least three registration pins; winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate in the radial direction of said plate cylinder using said plate rear end fixing mechanism after the completion of said winding; whereby elongation of said flexible printing plate in its maximum printing length in the rotational direction of said plate cylinder during said printing plate attaching operation is controlled not more than 100 μm, can achieve a good position accuracy of printing plate attachment, and prevent the plate slippage during printing and stain in the non-image area.

By practicing the methods in the second to fifth embodiments and carrying out the printing evaluation in the same manner as described above, similar results were obtained. From these results, the superiority of the invention was confirmed.

As described above, according to the method and apparatus for attaching a flexible printing plate, particularly a digitally prepared flexible printing plate, of the invention, the dimensional stability of the printing plate during plate-attaching operation markedly improves, the plate slippage and stain in the non-image area during printing can be prevented, and the registration accuracy for multi-color printing and the image quality comparable with those achieved by a metal-supported printing plate can be realized. Further, the attaching property of the flexible printing plate on the plate cylinder is greatly improved do that the operator's workload can be reduced. In addition, the method can be put into practice by a little modification of an existing printing press, resulting in saving of facility cost.

The entire disclosure of each and every foreign patent application from which the benefit of foreign priority has been claimed in the present application is incorporated herein by reference, as if fully set forth herein.

While the invention has been described in detail and with reference to specific examples thereof, it will be apparent to one skilled in the art that various changes and modifications can be made therein without departing from the spirit and score thereof.

What is claimed is:

1. A method of attaching a flexible printing plate on a plate cylinder comprising:

providing a flexible printing plate having a concavo-convex structure on a rear surface thereof and three or more notches at a plate front edge thereof;

providing an apparatus for attaching a flexible printing plate comprising:

a plate front end positioning mechanism comprising:

a plate front end clamping mechanism having upper teeth and lower teeth for fixing a plate front end of said printing plate to said plate cylinder; and at least three registration pins respectively provided in said plate front end clamping mechanism in such a manner that they are respectively opposed to said notches of said printing plate;

a printing plate pressing mechanism for pressing said printing plate toward said plate cylinder;

a plate rear end fixing mechanism for fixing a plate rear end of said printing plate to said plate cylinder; and a packing sheet having a concavo-convex structure at least on one surface thereof and being wound and fixed around said plate cylinder in such a manner that the surface having the concavo-convex structure is faced toward said printing plate;

positioning and fixing said plate front end to said plate cylinder by inserting said plate front end of said printing plate between said upper and lower teeth of said plate front end clamping mechanism to contact an inner peripheral surface of said notches of said plate front end with said at least three registration pins;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate using said plate rear end fixing mechanism after the completion of said winding;

whereby elongation of said flexible printing plate in its maximum printing length in the rotational direction of said plate cylinder during said printing plate attaching operation is controlled to be not more than 100 $\mu$m;

wherein a concavo-convex structure of the rear surface of said printing plate has Ra value of less than 1.5 $\mu$m (Ra: centerline average roughness).

2. A method of attaching a flexible printing plate as claimed in claim 1, wherein the concavo-convex structure of said packing sheet has Ra (Ra: centerline average roughness) of less than 2 $\mu$m.

3. A method of attaching a flexible printing plate as claimed in claim 1, wherein the concavo-convex structure of said packing sheet has Ra/Rz (Ra: centerline average roughness; Rz: ten-point average roughness) of less than 0.17.

4. A method of attaching a flexible printing plate on a plate cylinder comprising:

providing a flexible printing plate having a concavo-convex structure on a rear surface thereof and three or more notches at a plate front edge thereof;

providing an apparatus for attaching a flexible printing plate comprising:

a plate front end positioning mechanism comprising:

a plate front end clamping mechanism having upper teeth and lower teeth for fixing a plate front end of said printing plate to said plate cylinder; and at least three registration pins respectively provided in said plate front end clamping mechanism in such a manner that they are respectively opposed to said notches of said printing plate;

a printing plate pressing mechanism for pressing said printing plate toward said plate cylinder;

a plate rear end fixing mechanism for fixing a plate rear end of said printing plate to said plate cylinder; and a packing sheet having a concavo-convex structure at least on one surface thereof and being wound and fixed around said plate cylinder in such a manner that the surface having the concavo-convex structure is faced toward said printing plate;

positioning and fixing said plate front end to said plate cylinder by inserting said plate front end of said printing plate between said upper and lower teeth of said plate front end clamping mechanism to contact an inner peripheral surface of said notches of said plate front end with said at least three registration pins;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate using said plate rear end fixing mechanism after the completion of said winding;

whereby elongation of said flexible printing plate in its maximum printing length in the rotational direction of said plate cylinder during said printing plate attaching operation is controlled to be not more than 100 $\mu$m;

wherein the concavo-convex structure of said packing sheet has Ra (Ra: centerline average roughness) of less than 2 $\mu$m.

5. A method of attaching a flexible printing plate as claimed in claim 4, wherein the concavo-convex structure of said packing sheet has Ra/Rz (Ra: centerline average roughness; Rz: ten-point average roughness) of less than 0.17.

6. A method of attaching a flexible printing plate on a plate cylinder comprising:

providing a flexible printing plate having a concavo-convex structure on a rear surface thereof and three or more notches at a plate front edge thereof;

providing an apparatus for attaching a flexible printing plate comprising:

a plate front end positioning mechanism comprising:

a plate front end clamping mechanism having upper teeth and lower teeth for fixing a plate front end of said printing plate to said plate cylinder; and at least three registration pins respectively provided in said plate front end clamping mechanism in such a manner that they are respectively opposed to said notches of said printing plate;

a printing plate pressing mechanism for pressing said printing plate toward said plate cylinder;

a plate rear end fixing mechanism for fixing a plate rear end of said printing plate to said plate cylinder; and a packing sheet having a concavo-convex structure at least on one surface thereof and being wound and fixed around said plate cylinder in such a manner that the surface having the concavo-convex structure is faced toward said printing plate;

positioning and fixing said plate front end to said plate cylinder by inserting said plate front end of said printing plate between said upper and lower teeth of said plate front end clamping mechanism to contact an inner peripheral surface of said notches of said plate front end with said at least three registration pins;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate using said plate rear end fixing mechanism after the completion of said winding;

whereby elongation of said flexible printing plate in its maximum printing length in the rotational direction of said plate cylinder during said printing plate attaching operation is controlled to be not more than 100 $\mu$m;

wherein the concavo-convex structure of said packing sheet has Ra/Rz (Ra: centerline average roughness; Rz: ten-point average roughness) of less than 0.17.

7. A method of attaching a flexible printing plate on a plate cylinder comprising:

providing a flexible printing plate having a concavo-convex structure on the rear surface thereof and at least three fixing holes at a plate front edge thereof;

providing an apparatus for attaching a flexible printing plate comprising:

a plate front end positioning mechanism comprising:

a plate front end clamping mechanism having upper teeth and lower teeth for fixing a plate front end of said printing plate to said plate cylinder; registration pins provided in said plate front end clamping mechanism; and a pin contact member, which has higher rigidity than said printing plate, is attached to said registration pins and has at least three fixing pins for fixing said printing plate;

a printing plate pressing mechanism for pressing said printing plate toward said plate cylinder;

a plate rear end fixing mechanism for fixing a plate rear end of said printing plate to said plate cylinder; and a packing sheet having a concavo-convex structure at least on one surface thereof and being wound and fixed around said plate cylinder in such a manner that the surface having the concavo-convex structure is faced toward said printing plate;

positioning and fixing said plate front end to said plate cylinder by inserting said respective fixing pins of said pin contact member between said upper and lower teeth of said plate front end clamping mechanism into said respective fixing holes of said printing plate;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate using said plate rear end fixing mechanism after the completion of said winding;

whereby elongation of said flexible printing plate in its maximum printing length in the rotational direction of said plate cylinder during said printing plate attaching operation is controlled to be not more than 100 $\mu$m;

wherein the concavo-convex structure of said packing sheet has Ra (Ra: centerline average roughness) of less than 2 $\mu$m.

8. A method of attaching a flexible printing plate on a plate cylinder comprising:

providing a flexible printing plate having a concavo-convex structure on the rear surface thereof and at least three fixing holes at a plate front edge thereof;

providing an apparatus for attaching a flexible printing plate comprising:

a plate front end positioning mechanism comprising:

a plate front end clamping mechanism having upper teeth and lower teeth for fixing a plate front end of said printing plate to said plate cylinder; registration pins provided in said plate front end clamping mechanism; and a pin contact member, which has higher rigidity than said printing plate, is attached to said registration pins and has at least three fixing pins for fixing said printing plate;

a printing plate pressing mechanism for pressing said printing plate toward said plate cylinder;

a plate rear end fixing mechanism for fixing a plate rear end of said printing plate to said plate cylinder; and a packing sheet having a concavo-convex structure at least on one surface thereof and being wound and fixed around said plate cylinder in such a manner that the surface having the concavo-convex structure is faced toward said printing plate;

positioning and fixing said plate front end to said plate cylinder by inserting said respective fixing pins of said pin contact member between said upper and lower teeth of said plate front end clamping mechanism into said respective fixing holes of said printing plate;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate using said plate rear end fixing mechanism after the completion of said winding;

whereby elongation of said flexible printing plate in its maximum printing length in the rotational direction of said plate cylinder during said printing plate attaching operation is controlled to be not more than 100 $\mu$m;

wherein the concavo-convex structure of said packing sheet has Ra/Rz (Ra: centerline average roughness; Rz: ten-point average roughness) of less than 0.17.

9. A method of attaching a flexible printing plate on a plate cylinder comprising:

providing a flexible printing plate having a concavo-convex structure on the rear surface thereof and at least three fixing holes at a plate front edge thereof;

providing an apparatus for attaching a flexible printing plate comprising:

a plate front end positioning mechanism comprising:

a plate front end clamping mechanism having upper teeth and lower teeth for fixing a plate front end of said printing plate to said plate cylinder; registration pins provided in said plate front end clamping mechanism; and a pin contact member, which has higher rigidity than said printing plate, is attached to said registration pins and has at least three fixing pins for fixing said printing plate;

a printing plate pressing mechanism for pressing said printing plate toward said plate cylinder;

a plate rear end fixing mechanism for fixing a plate rear end of said printing plate to said plate cylinder; and a packing sheet having a concavo-convex structure at least on one surface thereof and being wound and fixed around said plate cylinder in such a manner that the surface having the concavo-convex structure is faced toward said printing plate;

positioning and fixing said plate front end to said plate cylinder by inserting said respective fixing pins of said pin contact member between said upper and lower teeth of said plate front end clamping mechanism into said respective fixing holes of said printing plate;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate using said plate rear end fixing mechanism after the completion of said winding;

whereby elongation of said flexible printing plate in its maximum printing length in the rotational direction of said plate cylinder during said printing plate attaching operation is controlled to be not more than 100 $\mu$m;

wherein a concavo-convex structure of the rear surface of said printing plate has Ra value of less than 1.5 $\mu$m (Ra: centerline average roughness).

10. A method of attaching a flexible printing plate on a plate cylinder comprising:

providing a flexible printing plate having a concavo-convex structure on the rear surface thereof and at least three fixing holes at a plate front edge thereof;

providing an apparatus for attaching a flexible printing plate comprising:

a plate front end positioning mechanism comprising:

a plate front end clamping mechanism having upper teeth and lower teeth for fixing a plate front end of said printing plate to said plate cylinder; and registration pins provided in said plate front end clamping mechanism;

a printing plate pressing mechanism for pressing said printing plate toward said plate cylinder;

a plate rear end fixing mechanism for fixing a plate rear end of said printing plate to said plate cylinder;

a packing sheet having a concavo-convex structure at least on one surface thereof and being wound and fixed around said plate cylinder in such a manner that the surface having the concavo-convex structure is faced toward said printing plate; and a pin contact member which has higher rigidity than said printing plate and has at least three fixing pins for fixing said printing plate;

inserting said fixing pins of said pin contact member into said fixing holes of said printing plate, respectively, to fix;

positioning and fixing said printing plate to said plate cylinder by fixing a leading edge of said pin contact member to said registration pins between said upper and lower teeth of said plate front end clamping mechanism;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate using said plate rear end fixing mechanism after the completion of said winding;

whereby elongation of said flexible printing plate in its maximum printing length in the rotational direction of said plate cylinder during said printing plate attaching operation is controlled to be not more than 100 $\mu$m;

wherein a concavo-convex structure of said packing sheet has Ra (Ra: centerline average roughness) of less than 2 $\mu$m.

11. A method of attaching a flexible printing plate on a plate cylinder comprising:

providing a flexible printing plate having a concavo-convex structure on the rear surface thereof and at least three fixing holes at a plate front edge thereof;

providing an apparatus for attaching a flexible printing plate comprising:

a plate front end positioning mechanism comprising:

a plate front end clamping mechanism having upper teeth and lower teeth for fixing a plate front end of said printing plate to said plate cylinder; and registration pins provided in said plate front end clamping mechanism;

a printing plate pressing mechanism for pressing said printing plate toward said plate cylinder;

a plate rear end fixing mechanism for fixing a plate rear end of said printing plate to said plate cylinder;

a packing sheet having a concavo-convex structure at least on one surface thereof and being wound and fixed around said plate cylinder in such a manner that the surface having the concavo-convex structure is faced toward said printing plate; and a pin contact member which has higher rigidity than said printing plate and has at least three fixing pins for fixing said printing plate; inserting said fixing pins of said pin contact member into said fixing holes of said printing plate, respectively, to fix;

positioning and fixing said printing plate to said plate cylinder by fixing a leading edge of said pin contact member to said registration pins between said upper and lower teeth of said plate front end clamping mechanism;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate using said plate rear end fixing mechanism after the completion of said winding;

whereby elongation of said flexible printing plate in its maximum printing length in the rotational direction of said plate cylinder during said printing plate attaching operation is controlled to be not more than 100 $\mu$m;

wherein the concavo-convex structure of said packing sheet has Ra/Rz (Ra: centerline average roughness; Rz: ten-point average roughness) of less than 0.17.

12. A method of attaching a flexible printing plate on a plate cylinder comprising:

providing a flexible printing plate having a concavo-convex structure on the rear surface thereof and at least three fixing holes at a plate front edge thereof;

providing an apparatus for attaching a flexible printing plate comprising:

a plate front end positioning mechanism comprising:

a plate front end clamping mechanism having upper teeth and lower teeth for fixing a plate front end of said printing plate to said plate cylinder; and registration pins provided in said plate front end clamping mechanism;

a printing plate pressing mechanism for pressing said printing plate toward said plate cylinder;

a plate rear end fixing mechanism for fixing a plate rear end of said printing plate to said plate cylinder;

a packing sheet having a concavo-convex structure at least on one surface thereof and being wound and fixed around said plate cylinder in such a manner that the surface having the concavo-convex structure is faced toward said printing plate; and a pin contact member which has higher rigidity than said printing plate and has at least three fixing pins for fixing said printing plate; inserting said fixing pins of said pin contact member into said fixing holes of said printing plate, respectively, to fix;

positioning and fixing said printing plate to said plate cylinder by fixing a leading edge of said pin contact member to said registration pins between said upper and lower teeth of said plate front end clamping mechanism;

winding said printing plate on said plate cylinder by rotating said plate cylinder with said plate rear end kept free, while said printing plate pressing mechanism presses said printing plate toward the entire outer peripheral surface of said plate cylinder including a ridge portion thereof using a pressure member; and pressing and fixing said plate rear end of said printing plate using said plate rear end fixing mechanism after the completion of said winding;

whereby elongation of said flexible printing plate in its maximum printing length in the rotational direction of said plate cylinder during said printing plate attaching operation is controlled to be not more than 100 $\mu$m;

wherein a concavo-convex structure of the rear surface of said printing plate has Ra value of less than 1.5 $\mu$m (Ra: centerline average roughness).

* * * * *